US008047607B1

(12) United States Patent
Shokouhi et al.

(10) Patent No.: US 8,047,607 B1
(45) Date of Patent: Nov. 1, 2011

(54) MODULAR STACKABLE FURNITURE SYSTEMS

(76) Inventors: Behshad Shokouhi, Sherman Oaks, CA (US); Teri Rudin, Encino, CA (US)

( * ) Notice: Subject to any disclaimer, the term of this patent is extended or adjusted under 35 U.S.C. 154(b) by 503 days.

(21) Appl. No.: 11/556,617

(22) Filed: Nov. 3, 2006

Related U.S. Application Data

(63) Continuation-in-part of application No. 11/149,038, filed on Jun. 8, 2005.

(60) Provisional application No. 60/733,957, filed on Nov. 4, 2005, provisional application No. 60/777,889, filed on Feb. 28, 2006, provisional application No. 60/656,771, filed on Feb. 25, 2005, provisional application No. 60/578,187, filed on Jun. 8, 2004.

(51) Int. Cl.
*A47C 3/04* (2006.01)

(52) U.S. Cl. ..... 297/239; 297/451.8; 297/283.2

(58) Field of Classification Search ..... 297/239, 297/440.1, 440.14, 451.8, 283.2, 283.1, 283.3, 297/DIG. 6, 228.12, 225; 211/27; 206/326
See application file for complete search history.

(56) References Cited

U.S. PATENT DOCUMENTS

| | | | | |
|---|---|---|---|---|
| 2,184,470 | A | 12/1939 | Primavera | |
| 2,628,668 | A * | 2/1953 | Basile | 297/440.2 X |
| 2,940,597 | A * | 6/1960 | Machielse et al. | 211/27 |
| 2,961,037 | A * | 11/1960 | Keefer | 297/440.15 |
| 3,057,661 | A * | 10/1962 | Moxley | 297/451.1 |
| 3,756,062 | A * | 9/1973 | Merola | 72/352 |
| 3,847,433 | A * | 11/1974 | Acton et al. | 297/239 |
| 4,254,992 | A | 3/1981 | Orosa | |
| 4,304,436 | A * | 12/1981 | Rowland | 297/239 |
| 4,456,296 | A * | 6/1984 | Rowland | 297/239 |
| 5,174,548 | A * | 12/1992 | Mueller | 254/10 C |
| 5,626,394 | A | 5/1997 | Perry | |
| 5,690,380 | A | 11/1997 | Waters | |
| 5,762,396 | A | 6/1998 | Barile | |
| 5,775,778 | A | 7/1998 | Riley et al. | |
| 5,779,317 | A | 7/1998 | Neal | |
| 5,957,528 | A | 9/1999 | Campbell | |
| 6,135,562 | A * | 10/2000 | Infanti | 297/440.2 |
| 6,428,098 | B1 | 8/2002 | Allbaugh | |
| 6,637,823 | B1 | 10/2003 | Ursini et al. | |
| 6,669,281 | B1 | 12/2003 | Huang | |
| 6,837,542 | B2 | 1/2005 | Barile et al. | |
| 6,899,396 | B2 * | 5/2005 | Bales | 297/446.2 |
| 7,011,367 | B2 * | 3/2006 | Riley | 297/228.1 |
| 7,118,175 | B2 * | 10/2006 | Crue | 297/239 |
| 7,147,286 | B2 | 12/2006 | Cesaroni et al. | |
| 7,240,964 | B2 * | 7/2007 | Riley | 297/228.12 X |
| 7,469,962 | B2 * | 12/2008 | Paulin | 297/229 |
| 2003/0090137 | A1 | 5/2003 | Piretti | |
| 2003/0164639 | A1 | 9/2003 | Infanti | |
| 2003/0209925 | A1 | 11/2003 | Bosman et al. | |

FOREIGN PATENT DOCUMENTS

| | | | |
|---|---|---|---|
| EP | 455565 | A1 | 11/1991 |
| FR | 2586916 | A3 * | 3/1987 |

* cited by examiner

*Primary Examiner* — Anthony D Barfield
(74) *Attorney, Agent, or Firm* — Stoneman Law Patent Group; Martin L. Stoneman

(57) ABSTRACT

Modular stackable furniture systems comprising chairs with modular removable seats, chair-leg covers, and/or chair-back covers. The chair frames are stackable and are structurally reinforced for heavy rental use, with specially reinforced frame, legs, and front feet. Methods of doing event-furniture rental and related business based on the space-saving and modular nature of the furniture are disclosed.

2 Claims, 18 Drawing Sheets

MODULAR STACKABLE FURNITURE SYSTEMS

CROSS-REFERENCE TO RELATED APPLICATIONS

The present application is related to application Ser. No. 60/578,187, filed Jun. 8, 2004, entitled "MODULAR STACKABLE FURNITURE SYSTEMS"; and is related to application Ser. No. 60/656,771, filed Feb. 25, 2005, entitled "MODULAR STACKABLE FURNITURE SYSTEMS"; and is related to and claims priority from application Ser. No. 11/149,038, filed Jun. 8, 2005, entitled "MODULAR STACKABLE FURNITURE SYSTEMS"; and is related to and claims priority from application Ser. No. 60/733,957, filed Nov. 4, 2005, entitled "MODULAR STACKABLE FURNITURE SYSTEMS"; and is related to and claims priority from application Ser. No. 60/777,889, filed Feb. 28, 2006, entitled "MODULAR STACKABLE FURNITURE SYSTEMS"; the contents of all of which are incorporated herein by this reference and are not admitted to be prior art with respect to the present invention by their mention in this cross-reference section.

BACKGROUND

This invention relates to providing improved modular stackable furniture systems. More particularly, this invention relates to providing stackable fixed-back chairs with modular seats. Even more particularly, this invention relates to providing stackable fixed-back chairs with interchangeable back covers and/or leg covers.

No system exists that permits furniture renters to fill diverse customer orders from a small stock of modular chair components and chair covers. No commercial rental chairs and chair covers exist that can be easily, inexpensively, and modularly repaired, updated, stored, and transported. No system exists that provides structurally reinforced stackable modular chairs for the rental industry. No system exists that provides a method of franchising stackable modular chair rental services.

Therefore, a need exists for a modular stackable furniture system that permits furniture renters to fill diverse customer orders from a small stock of modular chair components and chair covers. Further, a need exists for commercial rental chairs and chair covers that can be easily, inexpensively, and modularly repaired, updated, stored, and transported. Also, a need exists for a system that provides structurally reinforced stackable modular chairs for the rental industry. In addition, a need exists for a system that provides a method of franchising stackable modular chair rental services.

OBJECTS AND FEATURES OF THE INVENTION

A primary object and feature of the present invention is to overcome the above-stated problems and fill the above-stated needs. Another primary object and feature of the present invention is to provide modular stackable furniture systems.

It is a further object and feature of the present invention to provide such a system that permits a renter to provide many aesthetic furniture designs to customers from a small stock of modular components, and to provide many designs, sizes, shapes, and colors of event furniture from a limited set of compactly stored interchangeable components. It is a further object and feature of the present invention to provide such a system that includes apparatuses for storage and transportation of the modular furniture components.

It is a further object and feature of this invention to provide stackable chairs having replaceable seats, back-covers, and/or leg-covers. It is a further object and feature of this invention to provide stackable modular chairs strengthened and adapted to withstand rental use. It is a further object and feature of this invention to provide a method of franchising stackable modular chair rental services. It is a further object and feature of this invention to provide reinforcing chair feet.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a modular furniture system, relating to object-supporting furniture having modular portions, comprising: at least one chair frame comprising at least one back support, at least one seat support, at least four legs comprising at least two front legs and at least two rear legs; such at least one seat support comprising at least four longitudinal projections extending from at least one hub portion, and at least one plate connecting at least two of such at least four longitudinal projections; at least one chair seat; at least one attachment system structured and arranged to assist attachment and detachment of such at least one chair seat from such at least one seat support; wherein detachment of such at least one chair seat from such at least one seat support is effected by lifting such at least one chair seat away from such at least one seat support; wherein such at least one chair frame is structured and arranged to nest in a stack with at least one other substantially identical chair frame, when such at least one chair seat is detached from each such at least one seat support; wherein such at least one seat support further comprises horizontal-plane apertures structured and arranged to receive such at least two rear legs of at least one other substantially identical chair frame during stacking of multiple units of such chair frames; and wherein such at least one chair seat occludes such horizontal-plane apertures when attached to such at least one chair frame. Moreover, it provides such a modular furniture system wherein such at least one attachment system comprises at least one first portion associated with such at least one chair seat and at least one second portion associated with such at least one plate. Additionally, it provides such a modular furniture system wherein such at least one attachment system comprises at least one hook and loop fastener. Also, it provides such a modular furniture system further comprising at least one back-support cover. In addition, it provides such a modular furniture system, wherein such at least one back-support cover comprises at least one closure mechanism to secure such at least one back-support cover to such at least one back support. And, it provides such a modular furniture system wherein such at least one back-support cover comprises at least one fabric. Further, it provides such a modular furniture system wherein such at least one back-support cover comprises at least one fabric. Even further, it provides such a modular furniture system further comprising at least one chair-leg cover. Moreover, it provides such a modular furniture system further comprising at least one back-support cover. Additionally, it provides such a modular furniture system wherein such at least one seat support comprises at least two of such at least one plate. Also, it provides such a modular furniture system wherein such at least one seat support comprises at least three of such at least one plate. In addition, it provides such a modular furniture system wherein all of such at least four longitudinal projections are connected to at least one plate of such at least three plates. And, it provides such a modular furniture system wherein two adjacent longitudinal projections of such at least one seat support are not connected by at least one plate of such at least three plates. Further, it provides such a modular furniture system wherein such at least one back support extends upward from such at least one seat support and such at least four legs extend downward from such at least one seat support. Even further, it provides such a modular furniture system wherein each of such at least four legs comprises at least one metal tube comprising at least one bottom end structured and arranged to be adjacent the ground in use, at least one top end structured and arranged to be connected to such at least one seat support, at least one inside aperture diameter, at least one outside diameter, and at least one wall thickness; wherein at least one portion of such at least one metal tube, at least including such at least one bottom end, comprises at least one reduced outside diameter and at least one increased wall thickness relative to at least one other portion of such at least one metal tube. Moreover, it provides such a modular furniture system wherein such at least one portion comprises at least one work-hardened metal microstructure relative to such at least one other portion of such at least one metal tube. Additionally, it provides such a modular furniture system further comprising at least one seat support strengthener providing the substantially exclusive structural connection between such at least four legs. Also, it provides such a modular furniture system further comprising at least one chair-foot connected with each of such at least four legs. In addition, it provides such a modular furniture system wherein such at least one chair-foot increases stability of such at least one chair frame. And, it provides such a modular furniture system wherein such at least one chair-foot is weighted. Further, it provides such a modular furniture system wherein such at least one chair-foot is weighted to counterbalance such at least one chair frame against weight of such at least one back support to enhance ground stability of such at least one chair frame. Even further, it provides such a modular furniture system wherein such at least one chair-leg cover is adapted to cover such at least four legs. Moreover, it provides such a modular furniture system further comprising at least one chair-leg cover adapted to cover at least one of such at least four legs while not covering such at least one chair seat. Additionally, it provides such a modular furniture system further comprising at least one transporter adapted to transport a plurality of such at least one chair frame in at least one nested-stacked configuration. Also, it provides such a modular furniture system wherein such at least one transporter is wheeled. In addition, it provides such a modular furniture system wherein such at least one transporter comprises at least one forklift guide structured and arranged to assist lifting of such at least one transporter by at least one forklift. Furthermore, it provides such a modular furniture system wherein such at least one transporter comprises at least one chair frame holder adapted to hold at least two of such at least one chair frame which are stacked in a nesting configuration; and at least one chair seat holder adapted to hold at least two of such at least one chair seat detached from each such at least one chair frame; wherein such at least one transporter comprises at least three wheels. In addition, it provides such a modular furniture system wherein such at least one transporter comprises at least one transporter frame comprising at least one upper portion and at least one lower portion; at least one first chair frame holder connected with such at least one transporter frame; at least one second chair frame holder connected with such at least one transporter frame; wherein such at least one first chair frame holder and such at least one second chair frame holder are positioned between such at least one upper portion of such at least one transporter frame and such at least one lower portion of such at least one transporter frame; at least one basket connected with an upper portion of such at least one transporter frame; at least two forklift guides associated with a lower portion of such at least one transporter frame; and wheels.

In accordance with a preferred embodiment hereof, this invention provides a modular furniture system, relating to object-supporting furniture having modular portions, comprising: at least one chair frame adapted to frame at least one chair; at least one modular chair seat adapted to be removed from and placed on such at least one chair frame; and at least one releasable attacher adapted to releasably attach such at least one modular chair seat to such at least one chair frame; wherein such at least one chair frame comprises at least one back support adapted to support the back of at least one seated user; and wherein such at least one chair frame is adapted to allow nesting-stacking.

Moreover, it provides such a modular furniture system, further comprising at least one back-support cover adapted to substantially cover such at least one back support. Additionally, it provides such a modular furniture system, wherein such at least one back-support cover comprises at least one fabric. Also, it provides such a modular furniture system, wherein such at least one releasable attacher comprises at least one hook and loop fastener. In addition, it provides such a modular furniture system, wherein such at least one chair frame comprises: at least one frame support adapted to directly releasably support such at least one modular chair seat; and a plurality of thin leg-bars adapted to vertically support such at least one frame support above the ground; wherein such at least one frame support comprises at least one horizontal-plane aperture adapted to receive such at least one plurality of thin leg-bars of at least one other substantially identical chair frame during stacking of multiple units of such chair frames.

And, it provides such a modular furniture system, wherein at least one of such plurality of thin leg-bars comprises: at least one metal tube comprising at least one bottom end adapted to be adjacent the ground in use, at least one top end adapted to be connected to such at least one frame support, at least one inside aperture diameter, at least one outside diameter, and at least one wall thickness; wherein at least one portion of such at least one metal tube, at least including such at least one bottom end, comprises at least one reduced outside diameter and at least one increased wall thickness relative to at least one other portion of such at least one metal tube. Further, it provides such a modular furniture system, wherein such at least one portion comprises at least one work-hardened metal microstructure relative to such at least one other portion of such at least one metal tube.

Even further, it provides such a modular furniture system, further comprising at least one frame support strengthener adapted to strengthen such at least one frame support whereby such at least one frame support comprises the substantially exclusive structural connection between such plurality of thin leg-bars. Moreover, it provides such a modular furniture system, further comprising at least one transporter adapted to transport such plurality of such at least one chair frames in at least one nested-stacked configuration. Additionally, it provides such a modular furniture system, wherein such at least one transporter is adapted to transport at least about twenty-four nesting-stacked chair frames and at least about twenty-four modular chair seats simultaneously. Also, it provides such a modular furniture system, wherein such at least one transporter is adapted to transport at least about thirty-six nesting-stacked chair frames and at least about thirty-six modular chair seats simultaneously.

In addition, it provides such a modular furniture system, wherein such at least one transporter comprises: at least one chair frame holder adapted to hold at least two of such at least one chair frames which are nesting-stacked together; and at least one modular chair seat holder adapted to hold at least two of such at least one modular chair seats; wherein such at least one transporter comprises at least three wheels. And, it provides such a modular furniture system, wherein such at least one transporter comprises at least one forklift guide. And, it provides such a modular furniture system, further comprising at least one chair-foot adapted to increase the strength of such at least one chair frame. Further, it provides such a modular furniture system, wherein such at least one chair-foot comprises steel. Even further, it provides such a modular furniture system, wherein such at least one chair-foot is adapted to lower the center of gravity of such at least one chair frame. Moreover, it provides such a modular furniture system, wherein such at least one chair-foot is adapted to increase the tipping stability of such at least one chair frame. Additionally, it provides such a modular furniture system, wherein such at least one chair-foot is adapted to provide weight sufficient to increase the tipping stability of such at least one chair frame.

Also, it provides such a modular furniture system, wherein such at least one chair frame comprises at least one frame support adapted to directly releasably support such at least one modular chair seat and comprises a plurality of thin leg-bars adapted to vertically support such at least one frame support above the ground; further comprising at least one chair-leg cover adapted to cover at least one of such plurality of thin leg-bars and to not cover such at least one modular chair seat. In addition, it provides such a modular furniture system, wherein such at least one chair-leg cover is adapted to cover exactly four of such plurality of thin leg-bars and to not cover such at least one modular chair seat.

In accordance with another preferred embodiment hereof, this invention provides a modular furniture system, relating to stackable furniture having removable modular horizontal support portions, comprising the steps of: providing stackable furniture with removable horizontal supports and back covers; removing such horizontal supports; removing such back covers; nesting-stacking such stackable furniture; separately storing such back covers; and separately storing such horizontal supports. And, it provides such a modular furniture system, further comprising the steps of: providing stackable furniture with chair-leg covers; removing such chair-leg covers from such stackable furniture; and separately storing such chair-leg covers.

In accordance with another preferred embodiment hereof, this invention provides a modular furniture system, relating to stackable furniture having modular components, comprising the steps of: receiving at least one customer's selection of at least one chair frame; receiving such customer's selection of at least one chair seat; receiving such customer's selection of at least one back cover; and providing to such customer furniture comprising the selected components.

Further, it provides such a modular furniture system, further comprising the step of receiving such customer's selection of at least one chair-leg cover. Even further, it provides such a modular furniture system, further comprising the step of manufacturing such at least one chair frame. Even further, it provides such a modular furniture system, wherein such step of providing to such customer furniture comprising the selected components comprises the step of renting to such customer furniture comprising the selected components. Even further, it provides such a modular furniture system, wherein such step of providing to such customer furniture comprising the selected components comprises the step of selling to such customer furniture comprising the selected components. Even further, it provides such a modular furniture system, wherein such step of selling to such customer furniture comprising the selected components comprises the step of providing at least one franchise to such customer.

Even further, it provides such a modular furniture system, wherein such step of providing at least one franchise to such customer comprises the step of providing at least one chair rental territory to such at least one customer. Even further, it provides such a modular furniture system, wherein such step of providing at least one franchise to such customer comprises the step of offering at least one chair seat having at least one new aesthetic design to such at least one customer. Even further, it provides such a modular furniture system, wherein such step of providing at least one franchise to such customer comprises the step of offering at least one back cover having at least one new aesthetic design to such at least one customer. Even further, it provides such a modular furniture system, wherein such step of providing at least one franchise to such customer comprises the step of offering at least one chair frame having at least one new aesthetic design to such at least one customer. Even further, it provides such a modular furniture system, wherein such step of providing at least one franchise to such customer comprises the step of offering at least one chair-leg cover having at least one new aesthetic design to such at least one customer.

Even further, it provides each and every novel feature, element, combination, step and/or method disclosed or suggested by this provisional patent application.

DETAILED DESCRIPTION OF THE BEST MODES AND PREFERRED EMBODIMENTS OF THE INVENTION

Figure 1:
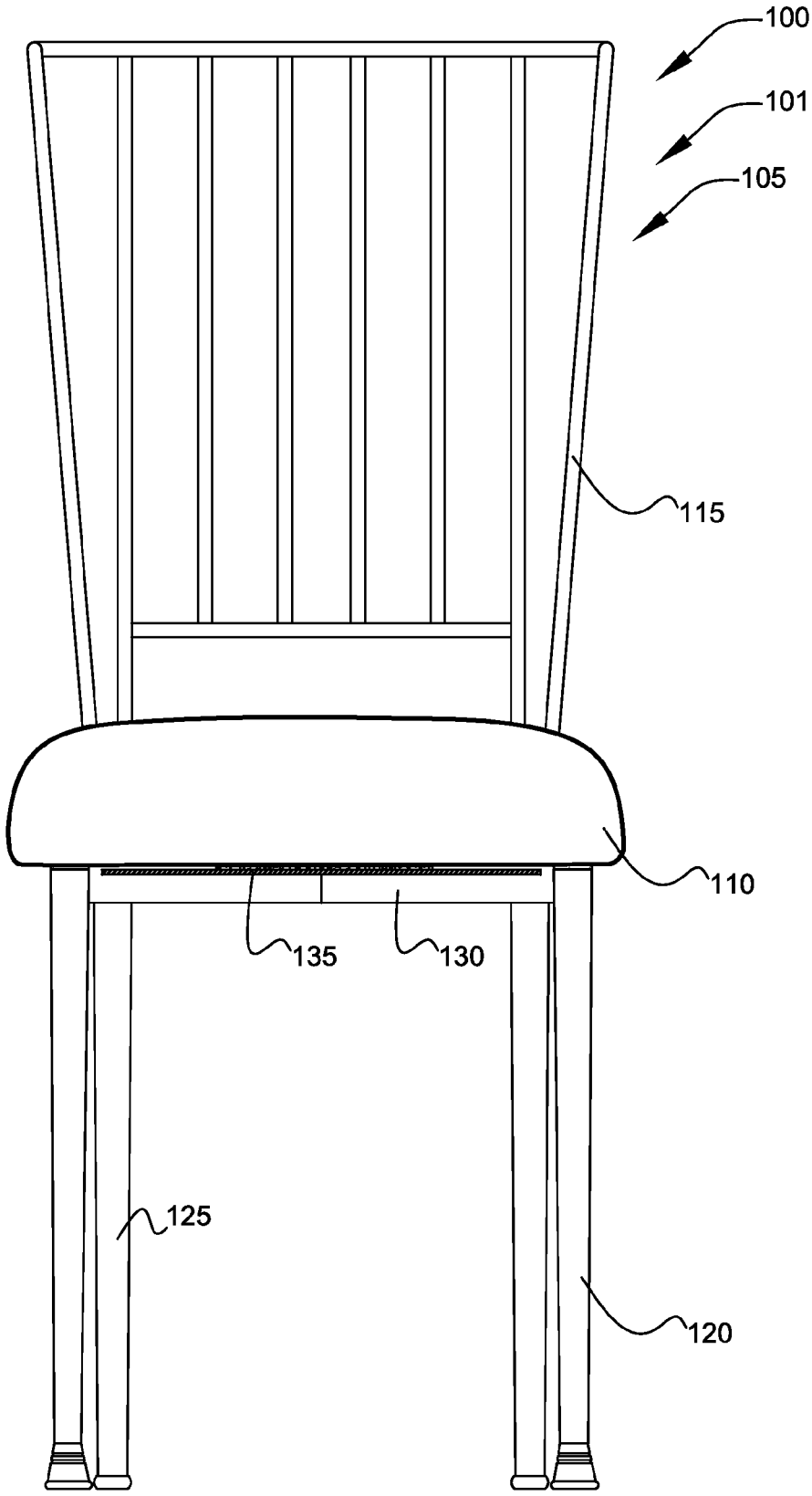
FIG. 1 shows a front view illustrating a modular stackable chair according to a preferred embodiment of the present invention.

FIG. 1 shows a front view illustrating modular stackable chair 101 according to a preferred embodiment of the present invention. Preferably, modular furniture system 100 comprises modular stackable chair 101, as shown. Preferably, modular stackable chair 101 comprises chair frame 105 and chair seat 110, as shown. Preferably, chair frame 105 comprises chair back 115, front legs 120, rear legs 125, crossbars 130, and crossbar plates 135, as shown. Preferably, chair seat 110 is easily removable from chair frame 105. Preferably, chair seat 110 attaches to chair frame 105 strongly enough to remain attached during normal use, but detaches quickly and easily for transportation, storage, and design changes. Preferably, multiple styles, designs, and colors of chair seats 110 may be attached to chair frame 105 to create a variety of chairs having different aesthetics. Upon reading the teachings of this specification, those of ordinary skill in the art will now understand that, under appropriate circumstances, such as user preference, advances in technology, intended use, etc., other interchangeable designs of chair backs, chair seats, and chair frames, such as various chair seat designs, various chair frame designs, various chair back designs, various materials, various colors, etc., may suffice.

Preferably, chair frame 105 comprises front legs 120 and rear legs 125 (at least embodying herein a plurality of thin leg-bars adapted to vertically support such at least one frame support above the ground), as shown. Upon reading the teachings of this specification, those of ordinary skill in the art will now understand that, under appropriate circumstances, such as user preference, advances in technology, intended use, etc., other chair frame components, such as additional struts, armrests, interlocks, wheels, handles, etc., may suffice.

Figure 12:
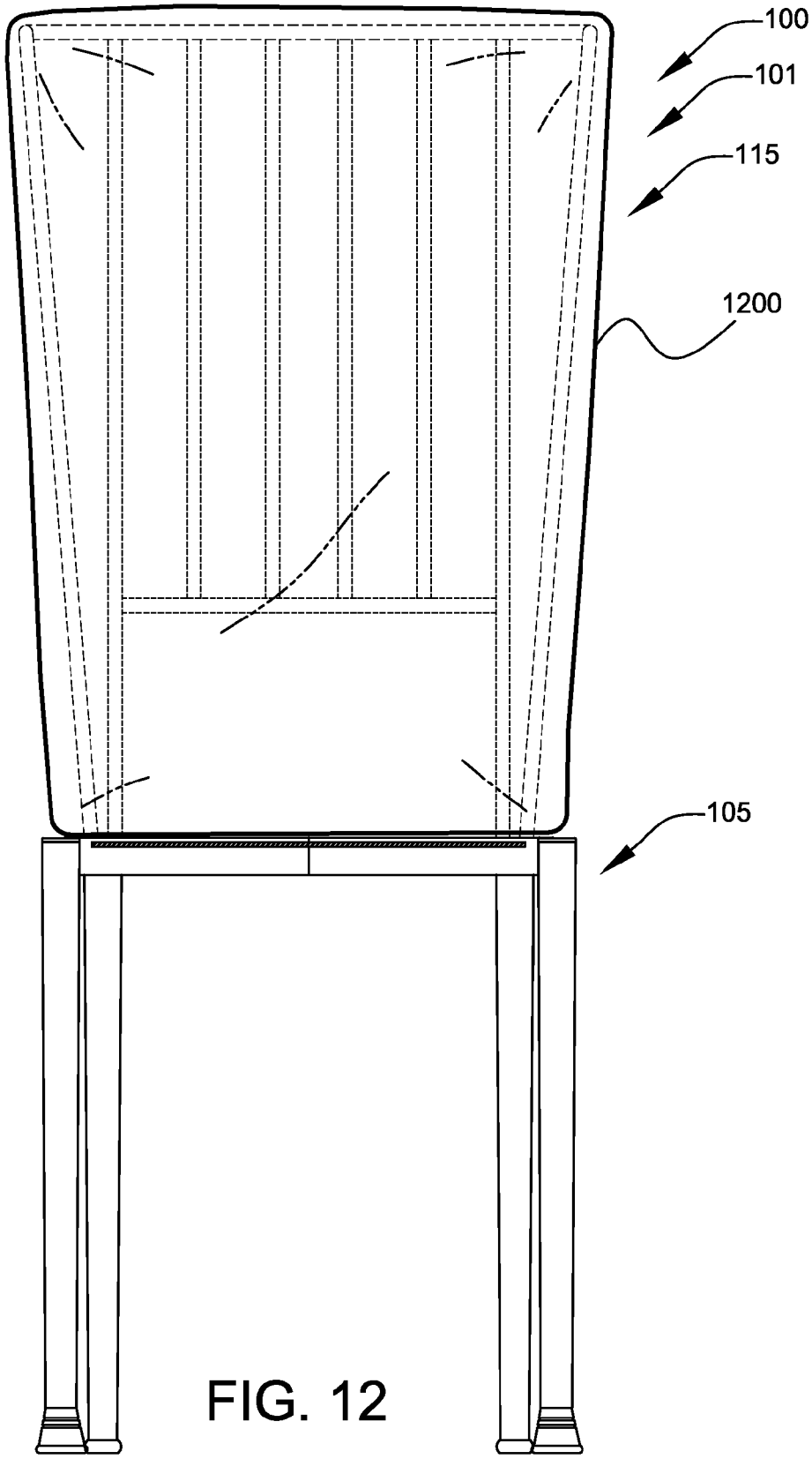
FIG. 12 shows a front view illustrating the modular stackable chair according to the preferred embodiment of FIG. 1 with the chair seat removed and using a chair-back cover.

Preferably, rental customers may choose the style, finish, color, etc., of each component of modular furniture system 100, creating modular stackable furniture meeting the customer's aesthetic requirements from a small and easily-stored rental stock of components. Preferably, furniture renters benefit by maintaining a small and varied stock of components able to meet almost any customer's needs. For example, a renter stocking one hundred pieces each of five chair frame 105 designs, ten chair seat 110 designs, and ten chair back cover 1200 designs (as shown in FIG. 12) can offer (not simultaneously) one hundred of each of five hundred different modular stackable chair 101 designs for rent from a stock of two thousand five hundred pieces. Using ordinary one-piece chairs, offering one hundred chairs in each of five hundred visually distinct designs would require a stock of fifty thousand chairs (or alternatively a stock of five thousand chairs in fifty different designs, plus one thousand chair back slipcovers in ten designs). The cost of purchasing, warehousing, and maintaining two thousand five hundred modular chair pieces is significantly less than the cost of purchasing, warehousing, and maintaining six thousand chairs and slipcovers or fifty thousand chairs.

Preferably, chair frame 105 comprises at least one strong, rigid material. More preferably, chair frame 105 comprises at least one metal. Most preferably, chair frame 105 comprises steel. Upon reading the teachings of this specification, those of ordinary skill in the art will now understand that, under appropriate circumstances, such as user preference, advances in technology, intended use, etc., other materials, such as other metals, plastics, wood, bamboo, composite materials, multiple materials, glass, etc., may suffice.

Preferably, in order to conserve weight and space, chair frame 105 is constructed with thin tubes, bars, and plates, preferably connected by welds, as shown. Upon reading the teachings of this specification, those of ordinary skill in the art will now understand that, under appropriate circumstances, such as user preference, advances in technology, intended use, materials, etc., other construction methods, such as rugged construction with larger tubes and struts, assembly with nuts and bolts, solid (non-tube) pieces, casting the metal chairs, using molded plastic, using adhesive, etc., may suffice.

Preferably, where chair frame 105 and chair back 115 (and/or chair seat 110) are made of metal the metal is coated for aesthetics and durability, most preferably powder coated. Preferably, the powder coat is of an attractive event-type color, such as gold vein, silver vein, black, white, purple, etc. Preferably, the event furniture renter keeps a stock of several colors and finishes of chair frame 105 which the customer may choose from. Upon reading the teachings of this specification, those with ordinary skill in the art will now understand that, under appropriate circumstances, considering such issues as advances in technology, user preference, etc., other finishes, such as unfinished metal, paint, enamel, electroplating, etc., may suffice.

Figure 2:
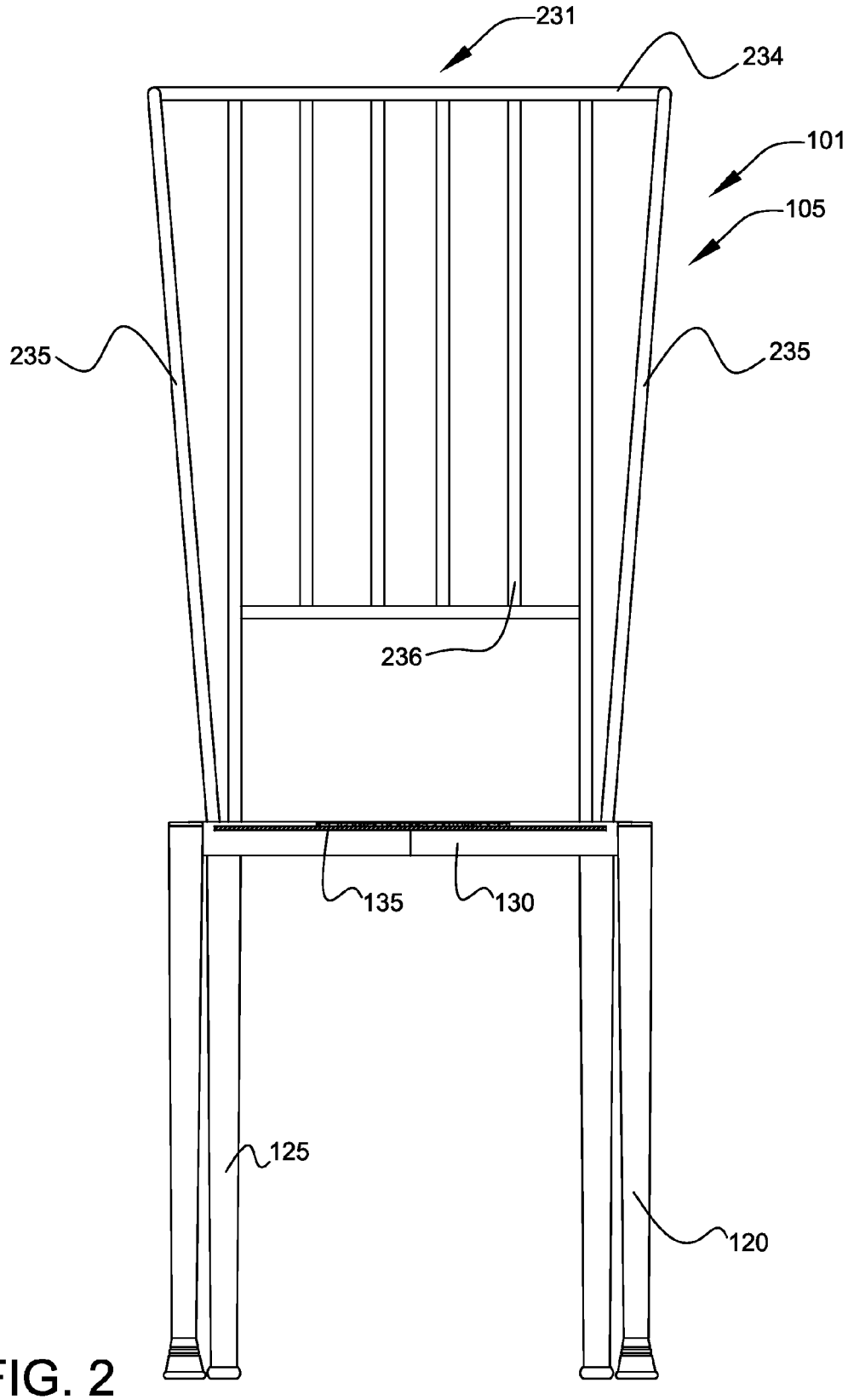
FIG. 2 shows a front view illustrating a chair frame for the modular stackable chair according to the preferred embodiment of FIG. 1.

FIG. 2 shows a front view illustrating chair frame 105 for modular stackable chair 101 according to the preferred embodiment of FIG. 1. Preferably, chair back 115 comprises back frame 231, preferably comprising top stretcher 234, frame attachments 235, and decorative elements 236, as shown. Back frame 231 is shown to illustrate one particular decorative embodiment of chair back 115. Upon reading the teachings of this specification, those with ordinary skill in the art will now understand that, under appropriate circumstances, considering such issues as advances in technology, user preference, etc., other decorative elements, such as solid material, other patterns of struts, ornate metalwork, empty space, wicker work, etc., may suffice.

Figure 3:
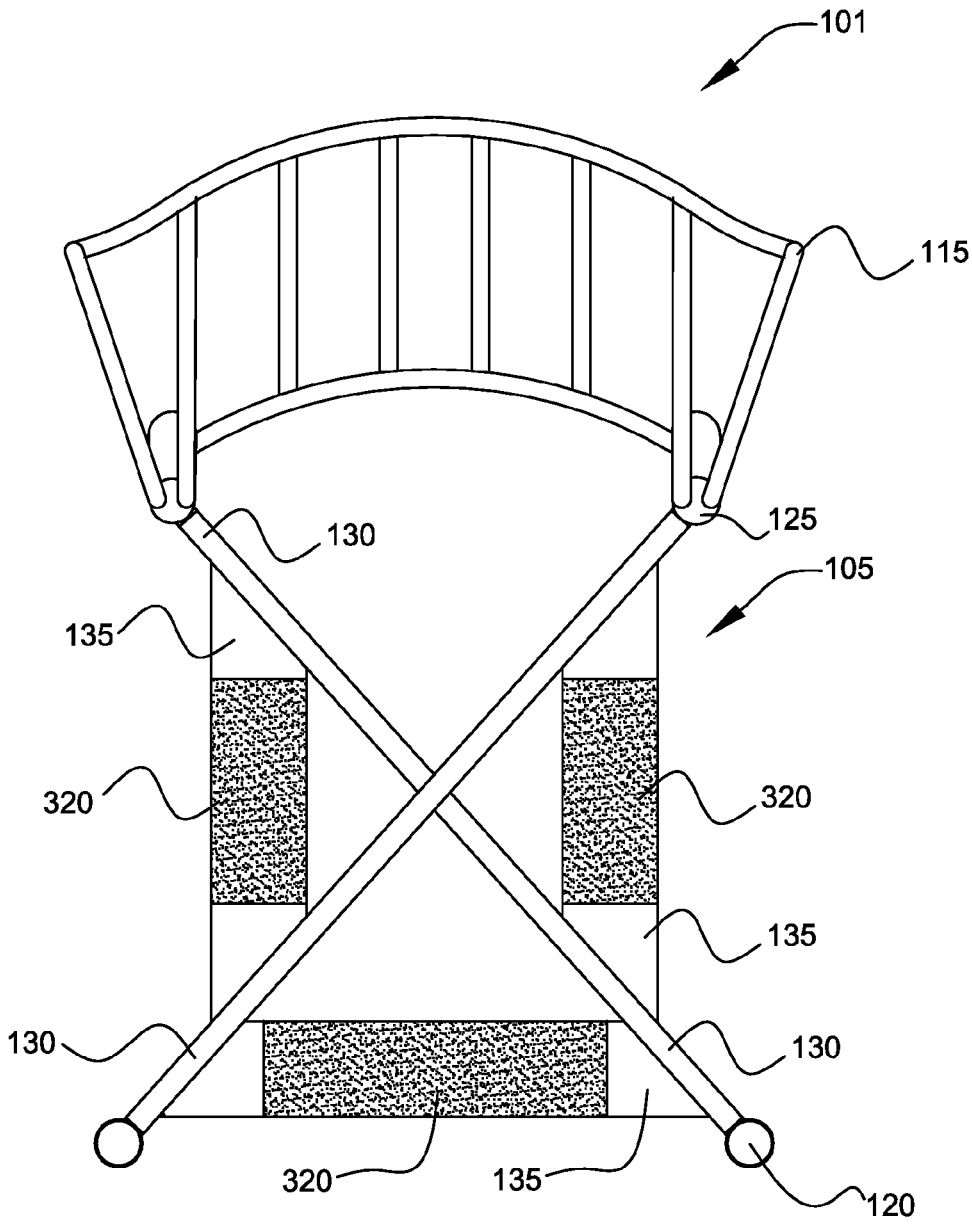
FIG. 3 shows a top view illustrating the modular stackable chair according to the preferred embodiment of FIG. 1.

FIG. 3 shows a top view illustrating modular stackable chair 101 according to the preferred embodiment of FIG. 1. Preferably, modular stackable chair 101 comprises seat attachers 320, as shown, which preferably function as positional stabilizers to provide positional stability of chair seat 110 on chair frame 105, as shown in FIG. 1. Preferably, seat attachers 320 comprise releasable fasteners, as shown. More preferably, seat attachers 320 comprise releasable pressure-activated fasteners, as shown. Most preferably seat attachers 320 comprise hook and loop fasteners 321, as shown. Preferably, one portion of hook and loop fasteners 321 are attached to the bottom of chair seat 110 (as shown, especially in FIG. 7C) in a position to engage the other portion of hook and loop fasteners 321 (which are preferably attached to chair frame 105) when chair seat 110 is properly positioned on chair frame 105, as shown. Preferably, the hook portions of hook and loop fasteners 321 are sewn and/or adhered to crossbar plates 135, as shown. Preferably, crossbar plates 135 also provide significant stiffening to the structure of chair frame 105. Upon reading the teachings of this specification, those of ordinary skill in the art will now understand that, under appropriate circumstances, such as user preference, advances in technology, intended use, etc., other seat attachment placements, such as on the crossbars, on only one crossbar plate, on the back struts, etc., may suffice.

Figure 4:
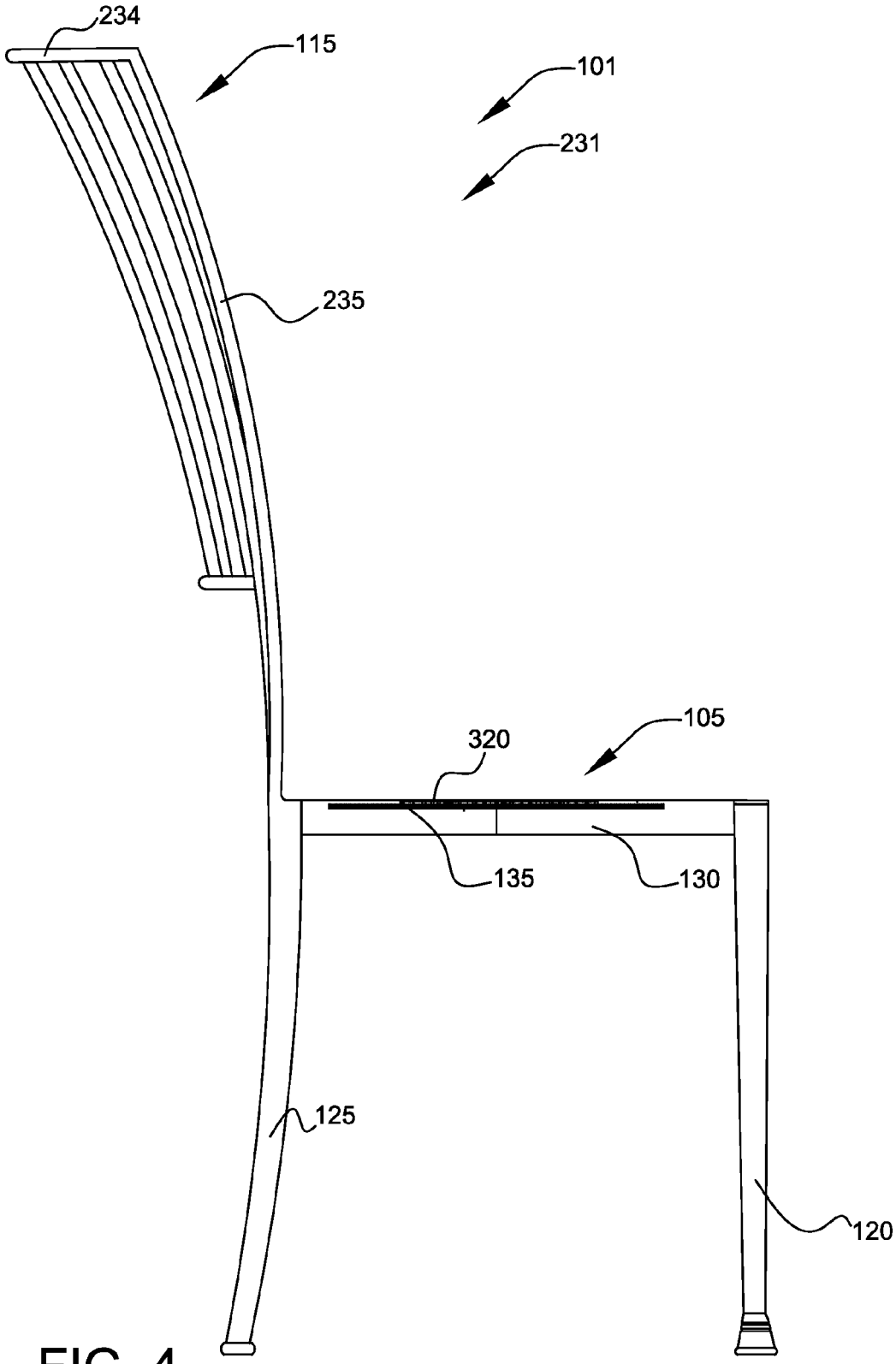
FIG. 4 shows a side view illustrating the modular stackable chair according to the preferred embodiment of FIG. 1.

FIG. 4 shows a side view illustrating modular stackable chair 101 according to the preferred embodiment of FIG. 1. Preferably, chair frame 105 is stackable. Preferably, front legs 120 are substantially straight (not curved), as shown. Preferably, front legs 120 are tapered to be narrower at the bottom ends, as shown.

Preferably, in order to meet the aesthetic demands of the ballroom chair use and/or rental trade, chair frame 105 has an elegant gently curved shape through chair back 115 and rear legs 125, as shown. Preferably, chair frame 105 is constructed using round steel tubes for front legs 120 and rear legs 125. Preferably, chair frame 105 is constructed using substantially rectangular steel tubes, bars, and/or plates for chair back 115, crossbars 130, and crossbar plates 135, as shown. Upon reading the teachings of this specification, those of ordinary skill in the art will now understand that, under appropriate circumstances, such as user preference, advances in technology, intended use, etc., other shapes and designs, such as other shapes of tubes and bars, baroque, art deco, angular, a rounded chair back, a straight chair back, straight rear legs, having arm rests, etc., may suffice.

Figure 5A:
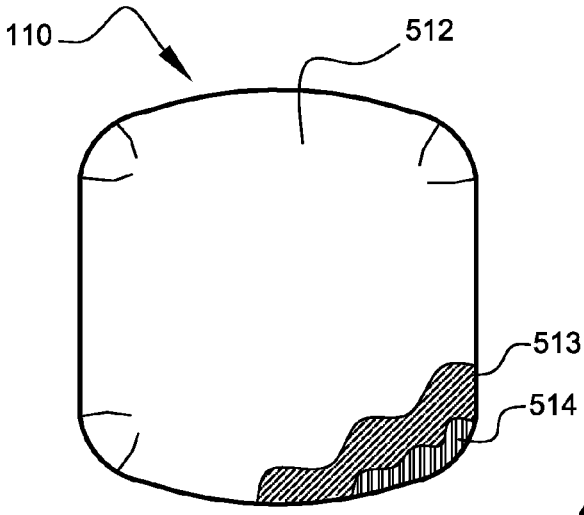
FIG. 5A shows a top plan view, partially in section, illustrating a chair seat according to the preferred embodiment of the present invention.

FIG. 5A shows a top plan view, partially in section, illustrating chair seat 110 according to a preferred embodiment of the present invention. Preferably, chair seat 110 is an upholstered chair seat at least comprising top layer 512, padding layer 513, and base 514, as shown. Preferably, top layer 512 comprises an attractive and durable surface such as, for example, fabric, leather, vinyl, etc. Preferably, padding layer 513 comprises at least one comfortable, durable padding material. Preferably, padding layer 513 comprises at least one of fiberfill, foam (polyurethane foam, memory foam, etc.), down, and/or cotton, etc. Preferably, base 514 comprises at least one durable, strong, rigid material. Preferably, base 514 comprises at least one of metal, wood, particleboard, plastic, and/or composite, etc. Preferably, chair seat 110 is of any size and shape that is attachable to chair frame 105, such as, for example, rounded square (as shown), rectangular, round, oval, tetrahedron, novelty, etc. Upon reading the teachings of this specification, those of ordinary skill in the art will now understand that, under appropriate circumstances, such as user preference, advances in technology, intended use, aesthetic preference, etc., other materials, layers, and designs, such as only a base layer, additional layers, body contour shapes, other materials, etc., may suffice.

Figure 5B:
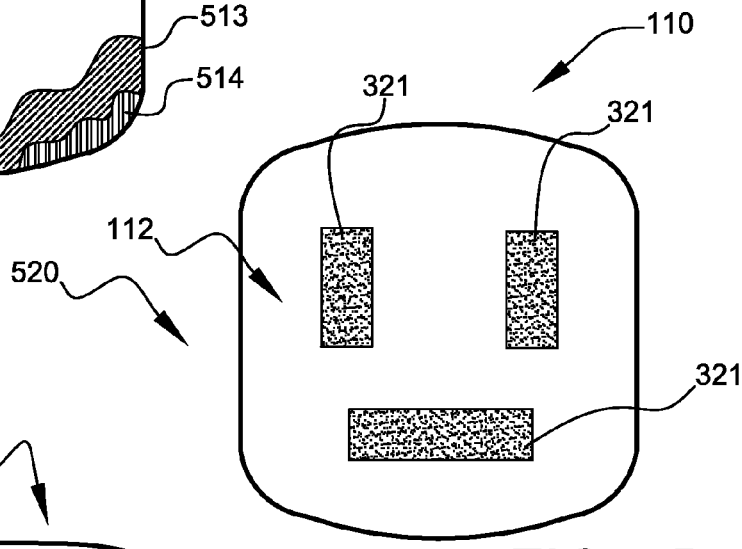
FIG. 5B shows a bottom plan view illustrating the chair seat according to the preferred embodiment of FIG. 5A.
Figure 6:
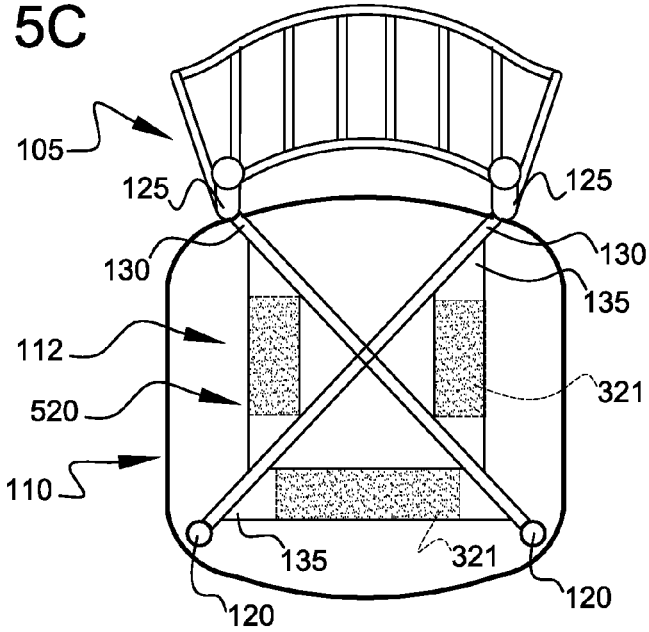
FIG. 6 shows a bottom plan view illustrating the chair seat (according to the preferred embodiment of FIG. 5A) attached to the modular stackable chair frame according to the preferred embodiment of FIG. 1.

FIG. 5B shows a bottom plan view illustrating chair seat 110 according to the preferred embodiment of FIG. 5A. Preferably, one portion of hook and loop fasteners 321 are attached to bottom 112 of chair seat 110 in a position to engage the other portion of hook and loop fasteners 321 (which are preferably attached to chair frame 105) when chair seat 110 is properly positioned on chair frame 105, as shown in FIG. 6. Preferably, the loop portions of hook and loop fasteners 321 are attached (preferably sewn and/or adhered) to bottom 112 of chair seat 110, as shown. Upon reading the teachings of this specification, those of ordinary skill in the art will now understand that, under appropriate circumstances, such as user preference, advances in technology, intended use, etc., other seat attachers, such as hooks, latches, snaps, straps, magnets, releasable adhesive, a single seat attacher, multiple types of seat attachers, etc., may suffice.

Figure 5C:
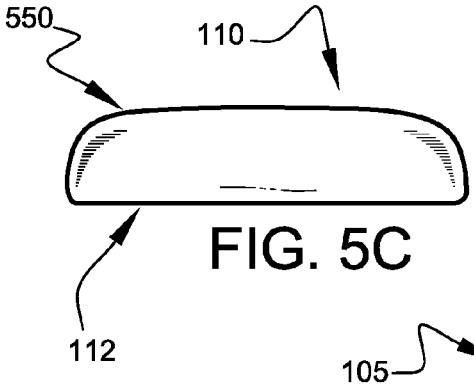
FIG. 5C shows a front plan view illustrating the chair seat according to the preferred embodiment of FIG. 5A.

FIG. 5C shows a front plan view illustrating chair seat 110 according to the preferred embodiment of FIG. 5A. Preferably, chair seat 110 has comfortable rounded edges 550, as shown. Upon reading the teachings of this specification, those of ordinary skill in the art will now understand that, under appropriate circumstances, such as user preference, advances in technology, intended use, etc., other chair seat shapes, such as flat, edges extending below the bottom of the seat, curved edges, scalloped edges, etc., may suffice.

FIG. 6 shows a bottom plan view illustrating chair seat 110 (according to the preferred embodiment of FIG. 5A) attached to modular stackable chair frame 105 according to a preferred embodiment of the present invention. Preferably, chair frame 105 comprises front legs 120, back legs 125, crossbars 130, and crossbar plates 135, as shown. Preferably, each crossbar 130 connects one front leg 120 and one back leg 125 together, as shown. Preferably, crossbars 130 cross, and are joined together by at least one hub portion, approximately in the middle of crossbars 130, as shown (such arrangement at least embodying herein at least four longitudinal projections extending from at least one hub portion). Preferably, crossbar plates 135 comprise strong, thin strips of material that connect crossbars 130 to each other, as shown (such arrangement at least embodying herein at least one plate connecting at least two of said at least four longitudinal projections). Preferably, crossbar plates 135 comprise metal. Preferably, crossbar plates 135 support seat attachers 320, as shown. Preferably, crossbar plates 135 are placed slightly below the top of crossbars 130, as shown, in order to accommodate the thickness of seat attachers 320 when seat 110 is placed upon crossbars 130, as shown in FIG. 1. Upon reading the teachings of this specification, those of ordinary skill in the art will now understand that, under appropriate circumstances, such as user preference, advances in technology, intended use, etc., other chair frame components, such as no crossbar plates, additional crossbar plates, other shapes of crossbar plates, thick crossbar plates, curved crossbars, etc., may suffice.

Preferably, chair seat 110 is installed on chair frame 105 by placing bottom 112 of chair seat 110 against crossbar plates 135, as shown, so that seat attachers 320 (at least embodying herein at least one releasable attacher adapted to releasably attach such at least one modular chair seat to such at least one chair frame) are pressed together and attach to each other. Preferably, using preferred hook-and-loop-type fasteners 321, chair seat 110 is removed from chair frame 105 by lifting up on chair seat 110 with sufficient force to release seat attachers 320 (at least embodying herein wherein such at least one releasable attacher comprises at least one hook and loop fastener). Then, chair frames 105 may be nesting-stacked and chair seats 110 may be stacked separately or otherwise stored.

Figure 17:
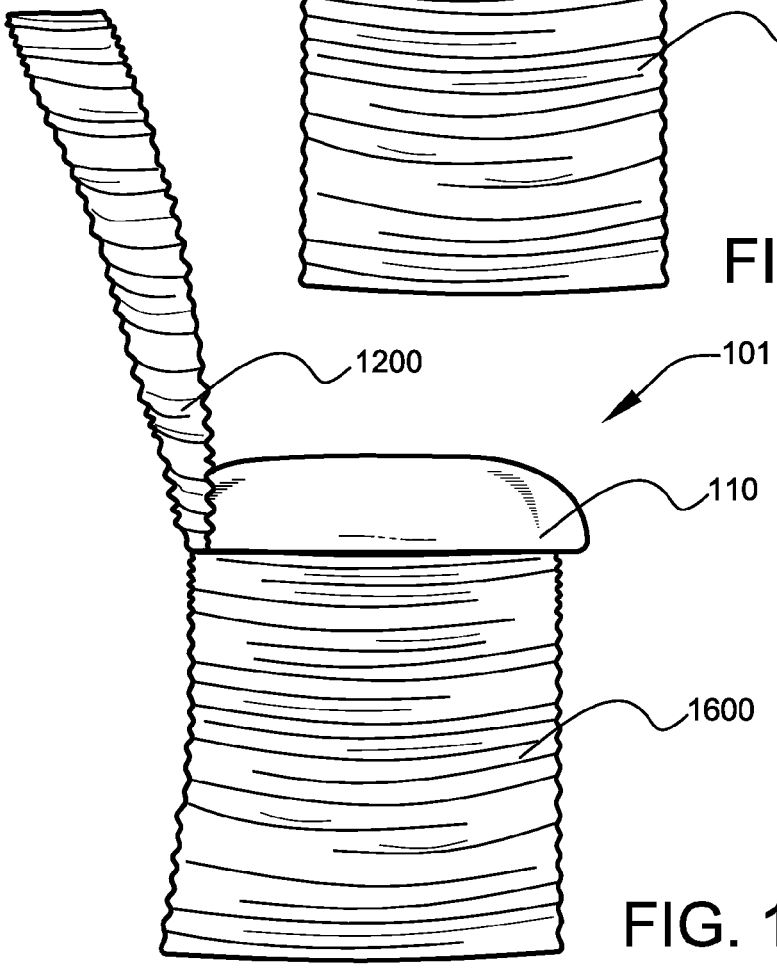
FIG. 17 shows a side view illustrating the modular stackable chair according to the preferred embodiment of FIG. 16 using a chair-back cover and using a chair-leg cover with the chair seat installed.

Preferably, crossbars 130 and/or the tops of front legs 120 create at least one horizontal plane of support 600 (at least embodying herein at least one frame support adapted to support such at least one modular chair seat) for chair seat 110, as shown. Preferably, chair seat 110 at least covers crossbars 130, crossbar plates 135, and the tops of front legs 120 in use, as shown. Preferably, rear legs 125 connect to chair back 115. Preferably, the rear edge of chair seat 110 abuts chair back 115 (at least embodying herein wherein such at least one chair frame comprises at least one back support adapted to support the back of at least one seated user), as shown in FIG. 17. Upon reading the teachings of this specification, those of ordinary skill in the art will now understand that, under appropriate circumstances, such as user preference, advances in technology, intended use, etc., other chair seat support contours, such as recessed, curved, etc., may suffice, as long as the chair seat is properly supported in use.

Figure 7:
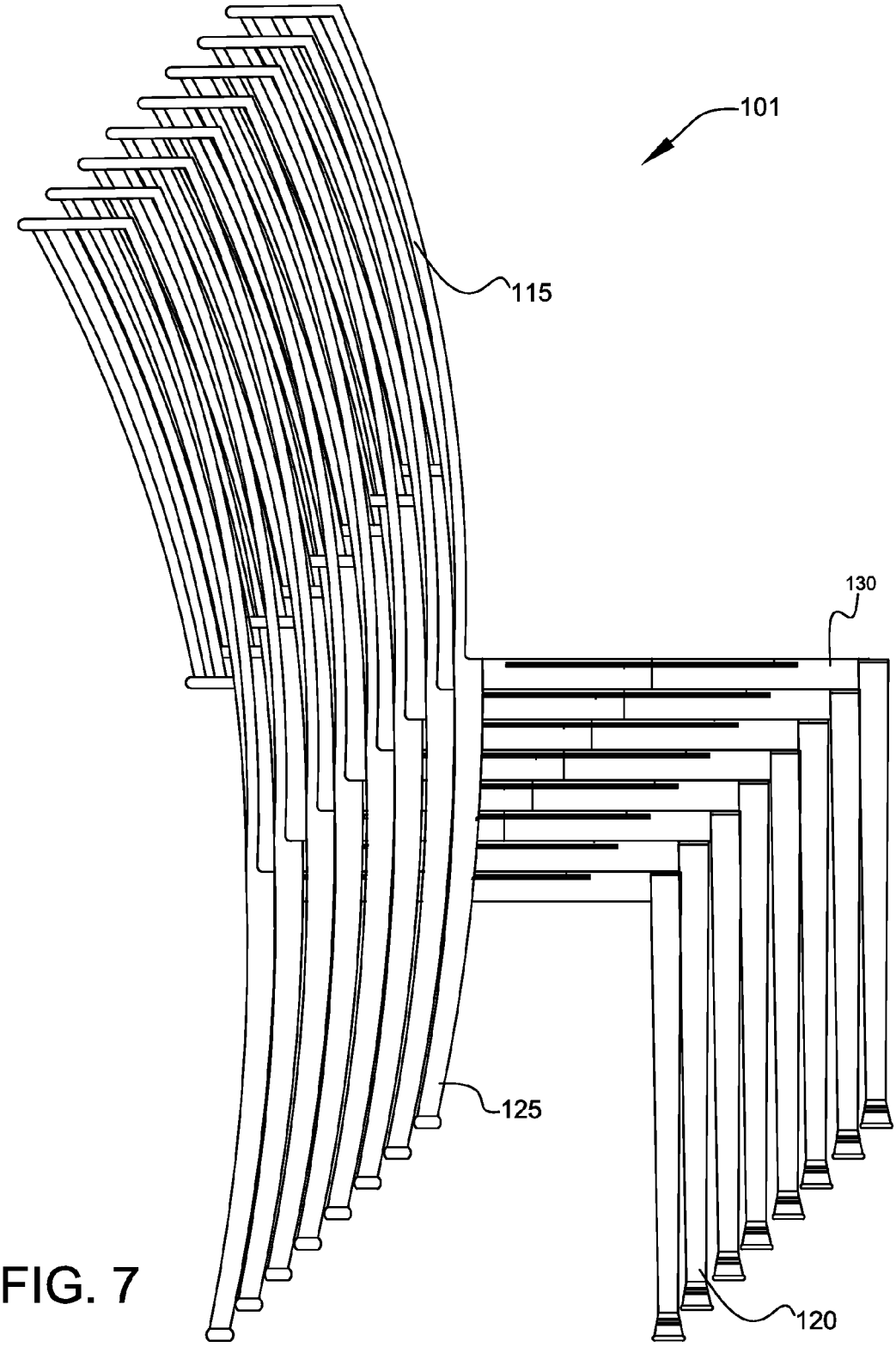
FIG. 7 shows a side view illustrating one stack of modular stackable chairs according to the preferred embodiment of FIG. 1.

FIG. 7 shows a side view illustrating one stack of modular stackable chairs 101 according to the preferred embodiment of FIG. 1. Preferably, chair frames 105 are nesting-stacked by placing the front legs 120 and back legs 125 of an upper chair frame 105 in front of the front legs 120 and back legs 125 of a lower chair frame 105 and resting the crossbars 130 of the upper chair frame 105 on top of the crossbars 130 of the lower chair frame 105, in a repeating fashion, as shown. Preferably, the open structure created by the X configuration of crossbars 130 (at least embodying herein wherein such at least one frame support comprises at least one horizontal-plane aperture adapted to receive such at least one plurality of thin leg-bars of at least one other substantially identical chair frame during stacking of multiple units of such chair frames) provides apertures for front legs 120 and back legs 125 of nested chair frames 105 (at least embodying herein wherein such at least one chair frame is adapted to allow nesting-stacking), as shown. Upon reading the teachings of this specification, those of ordinary skill in the art will now understand that, under appropriate circumstances, such as user preference, advances in technology, intended use, etc., other nesting-stackable chair frames may suffice.

Figure 8:
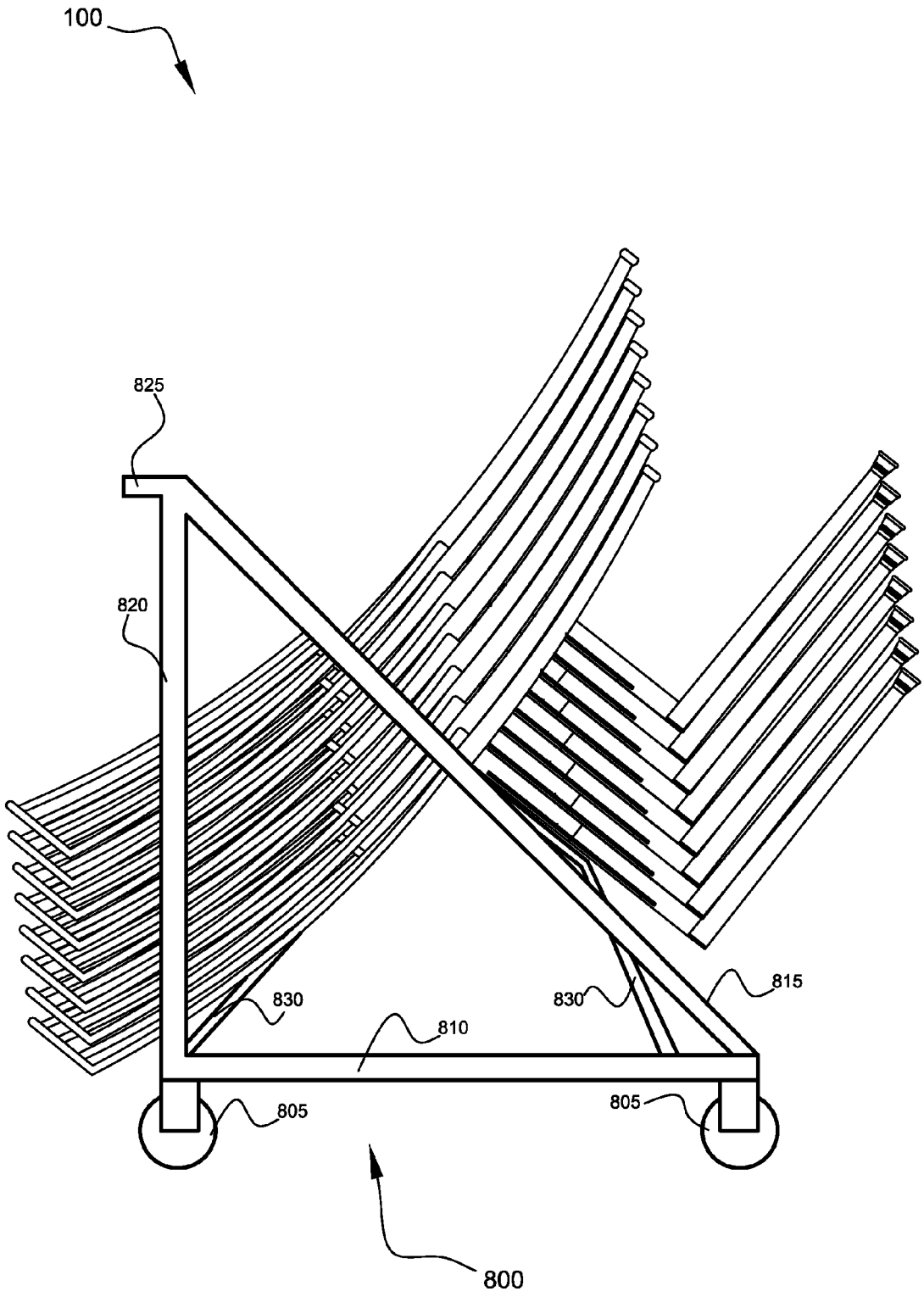
FIG. 8 shows a side plan view illustrating stacked chair frames on a dolly according to the preferred embodiment of FIG. 1.

FIG. 8 shows a side plan view illustrating stacked chair frames 105 on dolly 800 according to a preferred embodiment of the present invention. Preferably, modular furniture system 100 comprises dolly 800, as shown. Preferably, dolly 800 is adapted to transport many chair frames 105 in at least one nesting-stacked configuration, as shown. Preferably, dolly 800 comprises wheels 805, platform 810, side rail 815, back rail 820, handle 825, and chair support structure 830, as shown. Preferably, chair support structure 830 is shaped and angled to permit chair frames 105 to be inverted and stacked approximately vertically, as shown. Preferably, chair support structure 830 is raised above platform 810 to accommodate the length of chair backs 115, as shown. Preferably, for commercial purposes, up to about forty chair frames 105 may be stacked on dolly 800 in the manner shown. Upon reading the teachings of this specification, those of ordinary skill in the art will now understand that, under appropriate circumstances, such as user preference, advances in technology, intended use, etc., other dolly arrangements, such as no platform, addition of brakes, adjustable angle of the chair support structure, etc., may suffice.

The height of any nested stack of chair frames 105 is primarily a function of the thickness of crossbars 130, chair back 115, front legs 120, and back legs 125, as shown. The angle of rise of any nested stack of forty chair frames 105 is also primarily a function of the thickness of crossbars 130, chair back 115, front legs 120, and back legs 125, as shown. Therefore, the angle of chair support structure 830 must be set to support any nested stack of chair frames 105 having certain dimensions in an approximately vertical position; i.e., when chair frames 105 are redesigned with different dimensions, the chair support structure 830 will also be changed. In the present example, the angle of chair support structure 830 is approximately 32 degrees from vertical, as shown. Upon reading the teachings of this specification, those of ordinary skill in the art will now understand that, under appropriate circumstances, such as user preference, advances in technology, intended use, etc., other arrangements, such as adjustable angle chair support structures, etc., may suffice.

Figure 9:
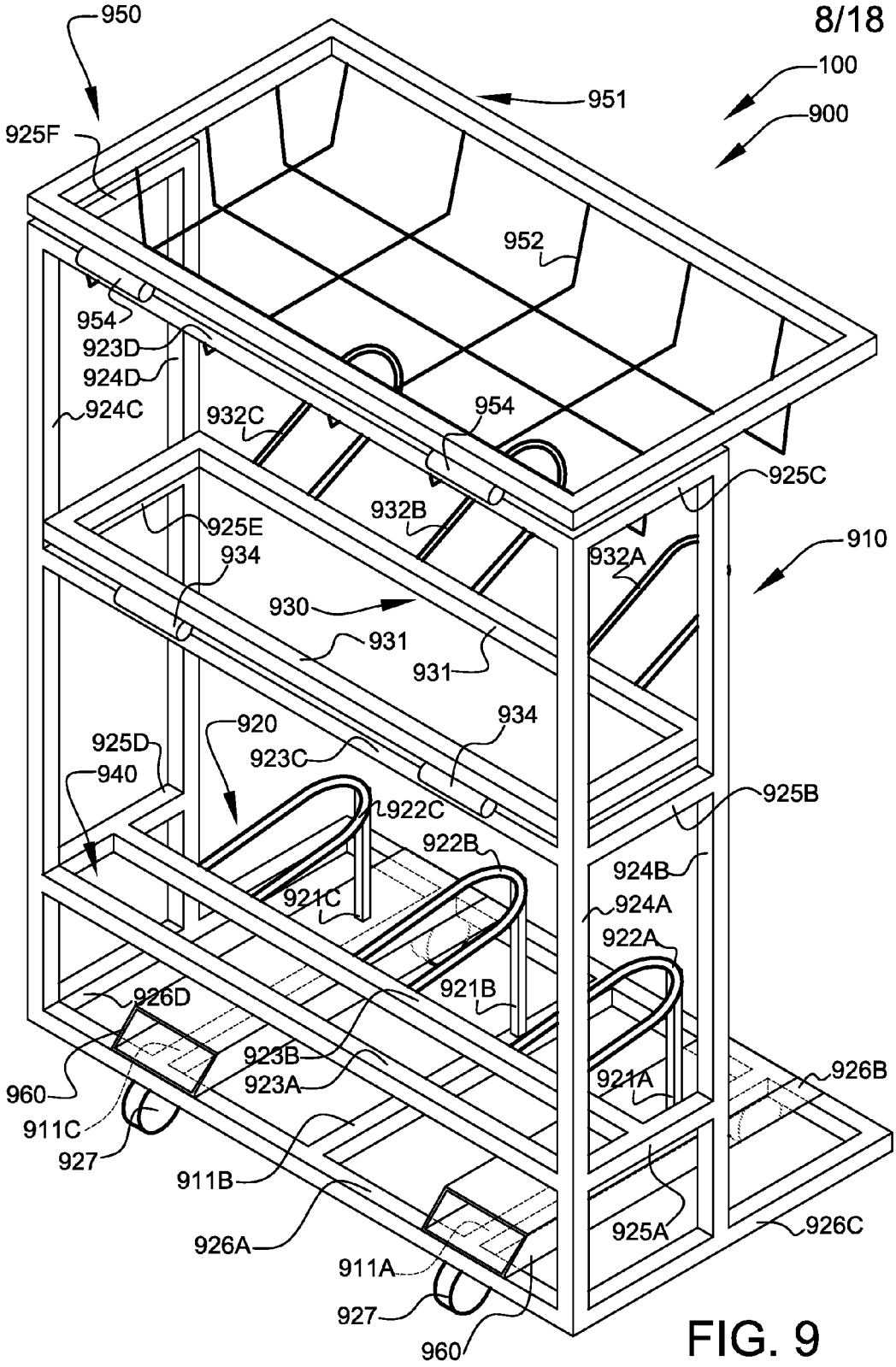
FIG. 9 shows a perspective view illustrating another dolly according to the preferred embodiment of the present invention.
Figure 10:
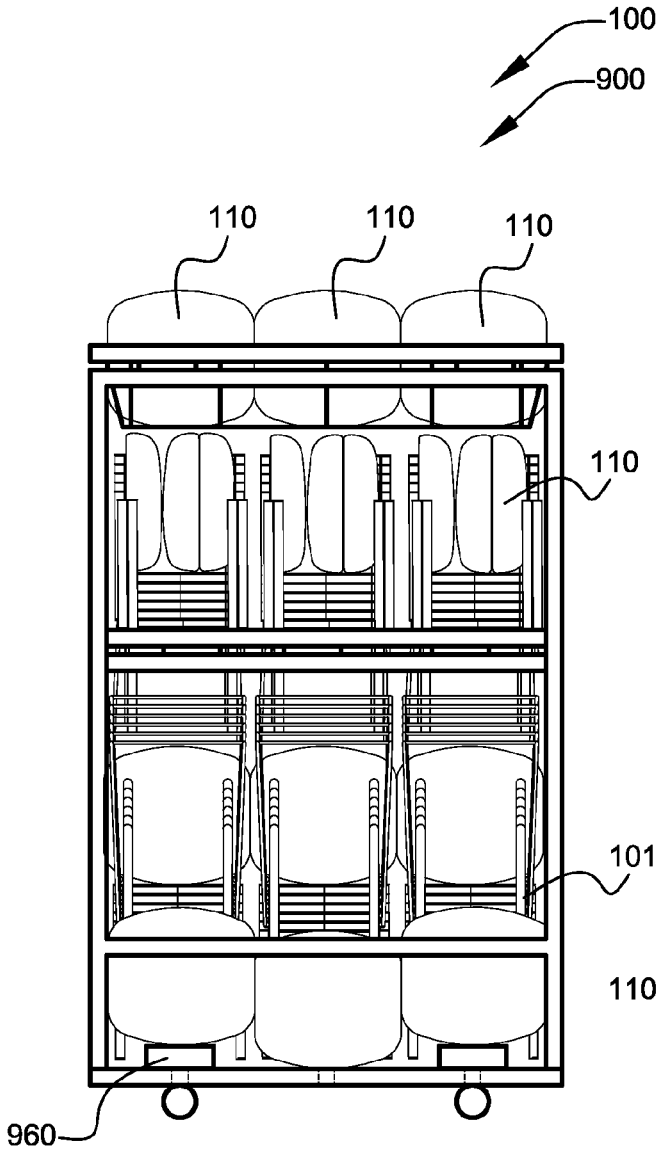
FIG. 10 shows a front view illustrating the dolly according to the preferred embodiment of FIG. 9 loaded with stacks of modular stackable chairs with the chair seats removed.

FIG. 9 shows a perspective view illustrating dolly 900 according to a preferred embodiment of the present invention. Preferably, modular furniture system 100 comprises dolly 900, as shown. Preferably, dolly 900 is adapted to carry modular stackable chairs 101, as shown. Preferably, dolly 900 is adapted to carry at least about twenty-four modular stackable chairs 101, as shown in FIG. 10. Preferably, dolly 900 (at least embodying herein at least one transporter adapted to transport such plurality of such at least one chair frames in at least one nested-stacked configuration) is adapted to carry at least about thirty-six modular stackable chairs 101, as shown in FIG. 10. Preferably, dolly 900 comprises frame 910, lower chair holder 920, upper chair holder 930, lower seat holder 940, and upper seat holder 950, as shown.

Preferably, frame 910 comprises: lower struts 911A, 911B, and 911C; horizontal struts 923A, 923B, 923C, and 923D; vertical struts 924A, 924B, 924C, and 924D; side struts 925A, 925B, 925C, 925D, 925E, and 925F; lower struts 926A, 926B, 926C, and 926D; and wheels 927 (at least embodying herein wherein such at least one transporter comprises at least three wheels), as shown.

Preferably, lower chair holder 920 comprises stack support 922A, stack support 922B, and stack support 922C, as shown. Preferably, lower chair holder 920 is supported by stack support struts 921A, 921B, and 921C, and by horizontal strut 923B, as shown.

Preferably, upper chair holder 930 comprises frame 931, stack support 932A, stack support 932B, stack support 932C, and hinges 934, as shown. Preferably, hinges 934 connect frame 931 to horizontal strut 923C, as shown. Preferably, hinges 934 permit upper chair holder 930 to be moved out of the way while lower chair holder 920 is being loaded. Preferably, stack supports 932A, 932B, and 932C are connected to frame 931 substantially above lower chair holder 920, as shown.

Preferably, lower seat holder 940 comprises horizontal struts 923A and 923B, lower struts 911A, 911B, and 911C, and side struts 925A and 925D, as shown.

Preferably, upper seat holder 950 comprises frame 951, basket 952, and hinges 954, as shown. Preferably, hinges 954 connect frame 951 to horizontal strut 923D, as shown. Preferably, basket 952 is connected to frame 951 substantially above upper chair holder 930, as shown. Preferably, hinges 954 permit upper seat holder 950 to be moved out of the way while upper chair holder 930 is being loaded. Preferably, dolly 900 is loaded from the bottom up.

Preferably, dolly 900 comprises forklift guides 960, as shown. Preferably, forklift guides 950 permit dolly 900 to be lifted and transported by a forklift. Preferably, forklift tubes 960 comprise metal tubes, preferably rectangular steel tubes. Preferably, forklift guides 960 (at least embodying herein wherein such at least one transporter comprises at least one forklift guide) are welded to frame 910, as shown. Upon reading the teachings of this specification, those with ordinary skill in the art will now understand that, under appropriate circumstances, considering such issues as advances in technology, user preference, materials strength, intended use, etc., other forklift adaptations, such as brackets instead of tubes, other forklift guide placement, etc., may suffice.

Preferably, dolly 900 is substantially constructed of metal. Most preferably, dolly 900 is substantially constructed of welded steel tubing, as shown. Upon reading the teachings of this specification, those with ordinary skill in the art will now understand that, under appropriate circumstances, considering such issues as advances in technology, user preference, intended use, intended number of chairs to carry, etc., other arrangements, such as other struts configurations, other numbers of upper seat holders, other numbers of lower seat holders, other numbers of upper chair holders, other numbers of lower chair holders, one or more levels of chair holders, one or more levels of seat holders, other materials, exterior walls and/or doors, dust covers, handles, other numbers of wheels, etc., may suffice.

FIG. 10 shows a front view illustrating dolly 900 according to the preferred embodiment of FIG. 9 loaded with stacks of modular stackable chairs 101 with chair seats 110 removed.

Preferably, six stacks of six modular stackable chairs 101 are storable and/or transportable on dolly 900, for a total of thirty-six modular stackable chairs 101 per dolly 900 (at least embodying herein wherein such at least one transporter is adapted to transport at least about twenty-four nesting-stacked chair frames and at least about twenty-four modular chair seats simultaneously; and at least embodying herein wherein such at least one transporter is adapted to transport at least about thirty-six nesting-stacked chair frames and at least about thirty-six modular chair seats simultaneously), as shown. Preferably, each of stack supports 932A, 932B, and 932C, and each of stack supports 922A, 922B, and 922C (at least embodying herein at least one chair frame holder adapted to hold at least two of such at least one chair frames which are nesting-stacked together), each hold six stacked chair frames 105, for a total of thirty-six chair frames 105 per dolly 900, as shown. Preferably, lower seat holder 940 holds at least three chair seats 110, upper seat holder 950 (at least embodying herein at least one modular chair seat holder adapted to hold at least two of such at least one modular chair seats) holds at least eighteen chair seats 110, at least six chair seats 110 are stored on the first stacks of modular stackable chairs 101 on lower chair holder 920, and at least nine chair seats 110 are stored on the second stacks of modular stackable chairs 101 on upper chair holder 930, for a total of thirty-six chair seats 110 per dolly 900, as shown. Preferably, dolly 900 fits through a standard thirty-six inch wide by eighty inch tall doorway when fully loaded. Upon reading the teachings of this specification, those with ordinary skill in the art will now understand that, under appropriate circumstances, considering such issues as advances in technology, user preference, etc., other arrangements, such as other seat placements, other numbers of seats and chairs, additional seat holders, a taller dolly that holds more chair frames per stack, etc., may suffice.

Figure 11:
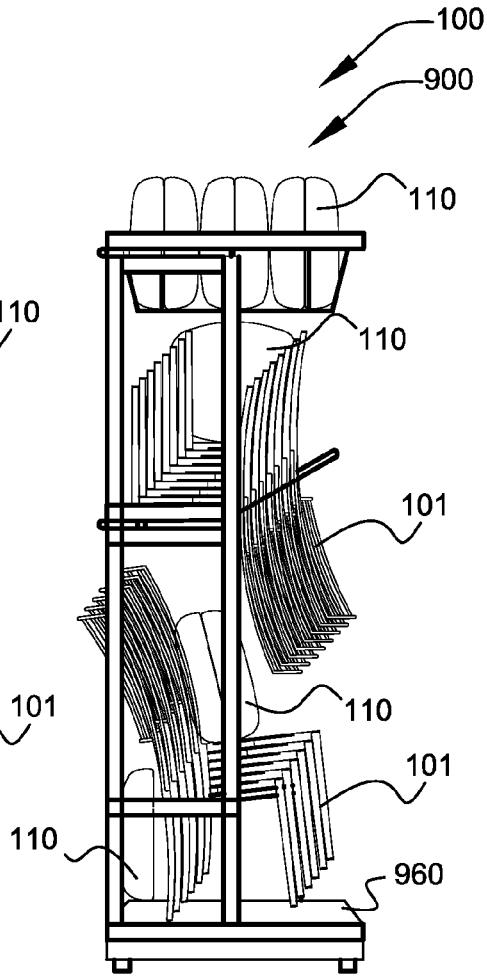
FIG. 11 shows a side view illustrating the dolly according to the preferred embodiment of FIG. 9 loaded with stacks of modular stackable chairs with the chair seats removed.

FIG. 11 shows a side view illustrating dolly 900 according to the preferred embodiment of FIG. 10 loaded with stacks of modular stackable chairs 101 with chair seats 110 removed.

FIG. 12 shows a front view illustrating modular stackable chair 101 with chair seat 110 removed, according to FIG. 11, using chair-back cover 1200. Preferably, modular furniture system 100 comprises chair-back cover 1200, as shown. Preferably, chair-back cover 1200 is adapted to cover chair back 115, as shown, preferably providing both user comfort and an attractive appearance. Preferably, chair-back cover 1200 (at least embodying herein wherein such at least one back-support cover comprises at least one fabric) comprises fabric, as shown. Preferably, chair-back cover 1200 (at least embodying herein at least one back-support cover adapted to substantially cover such at least one back support) is selected to either match or attractively contrast with the selected chair seat 110 (at least embodying herein at least one modular chair seat adapted to be removed from and placed on such at least one chair frame) and/or chair frame 105 (at least embodying herein at least one chair frame adapted to frame at least one chair). Upon reading the teachings of this specification, those with ordinary skill in the art will now understand that, under appropriate circumstances, considering such issues as advances in technology, user preference, etc., other chair-back cover arrangements, such as other materials, padding, stiffeners, liners, indicia, shape-altering inserts, etc., may suffice.

Figure 13:
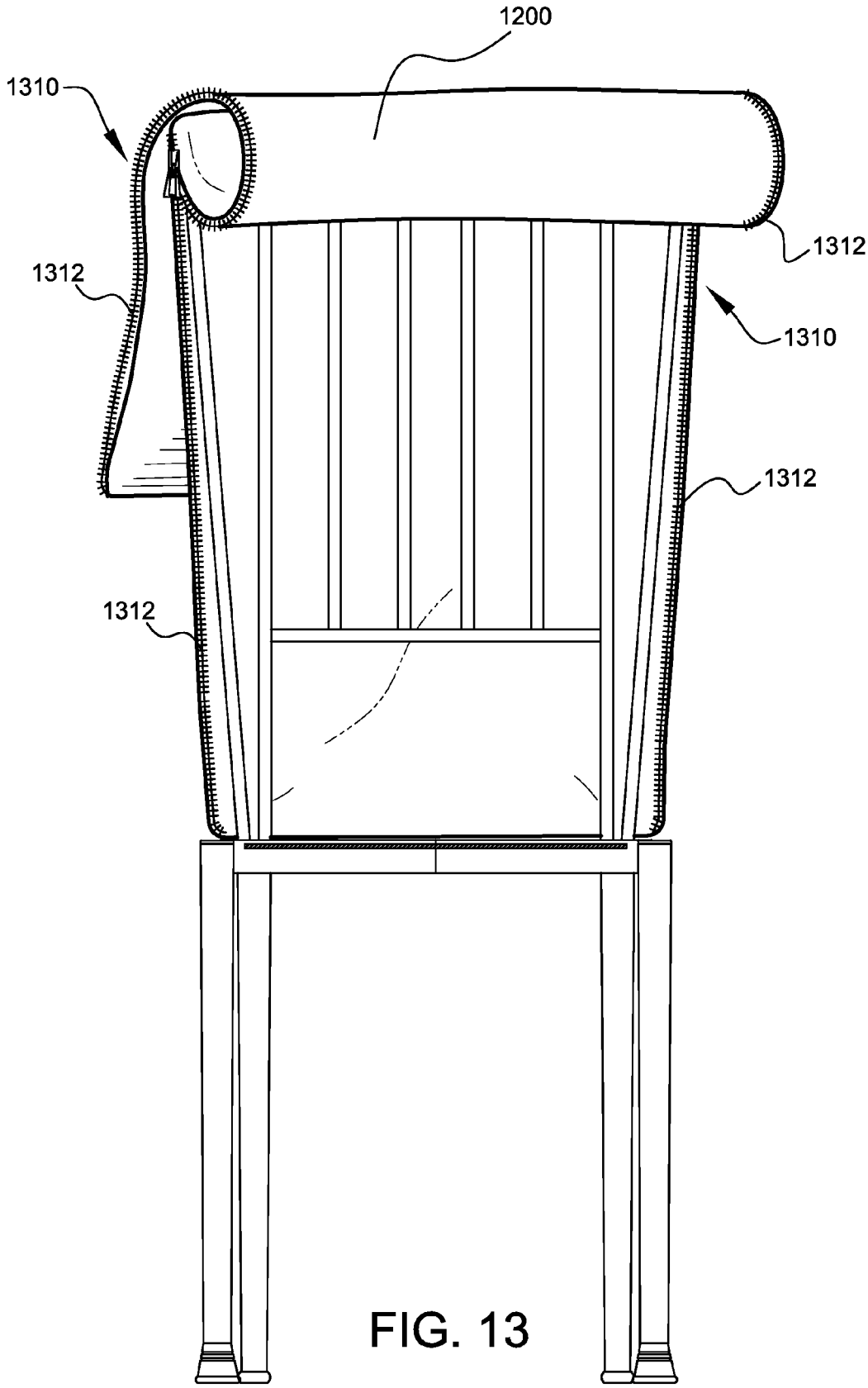
FIG. 13 shows a front view illustrating the modular stackable chair according to the preferred embodiment of FIG. 1 with the chair seat removed, using the chair-back cover, and showing the chair-back cover unzipped.

FIG. 13 shows a front view illustrating modular stackable chair 101 with chair seat 110 removed, according to the preferred embodiment of FIG. 12, using chair-back cover 1200 and showing chair-back cover 1200 unzipped. Preferably, especially where seat back 115 is wider at the top that at the bottom, cover 1200 opens and closes with attacher 1310 (at least embodying herein at least one closure mechanism to secure said at least one back-support cover to said at least one back support), as shown. Preferably, attacher 1310 comprises one or more zippers 1312, as shown. Upon reading the teachings of this specification, those with ordinary skill in the art will now understand that, under appropriate circumstances, considering such issues as advances in technology, user preference, design requirements, etc., other attachers, such as snaps, hook and loop fasteners, hooks and eyes, elastic portions of the chair-back cover, not using any attachers where the chair-back cover can slip on to the chair back, applying an attacher to the bottom opening of the chair-back cover, etc., may suffice.

Figure 14:
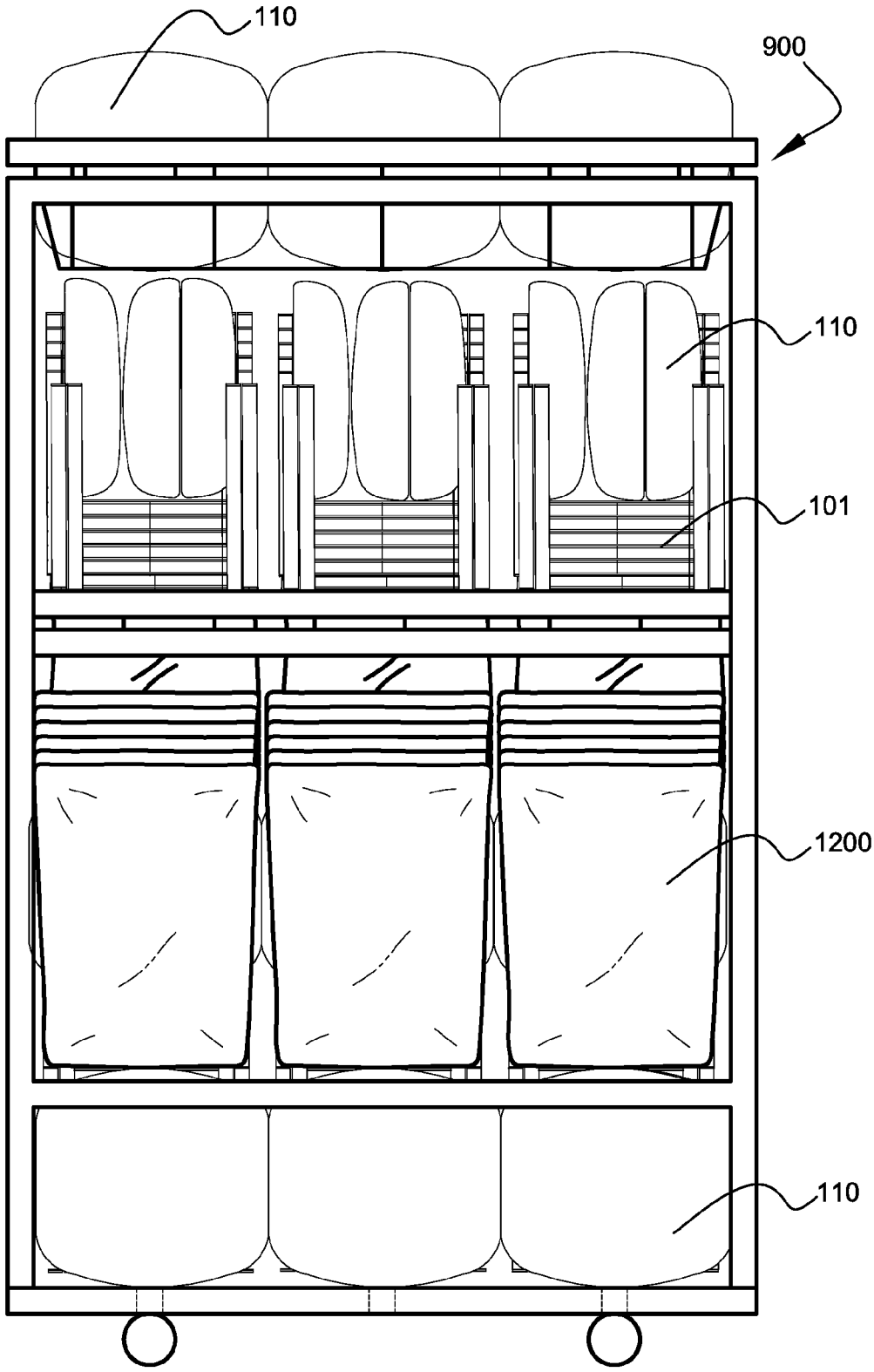
FIG. 14 shows a front view illustrating the dolly according to the preferred embodiment of FIG. 9 loaded with modular stackable chairs, using seat-back covers, and associated chair seats.

FIG. 14 shows a front view illustrating dolly 900 according to the preferred embodiment of FIG. 9 loaded with modular stackable chairs 101 (using seat-back covers 1200) and associated chair seats 110. Preferably, seat-back covers 1200 do not interfere with stacking modular stackable chairs 101, as shown.

Figure 15:
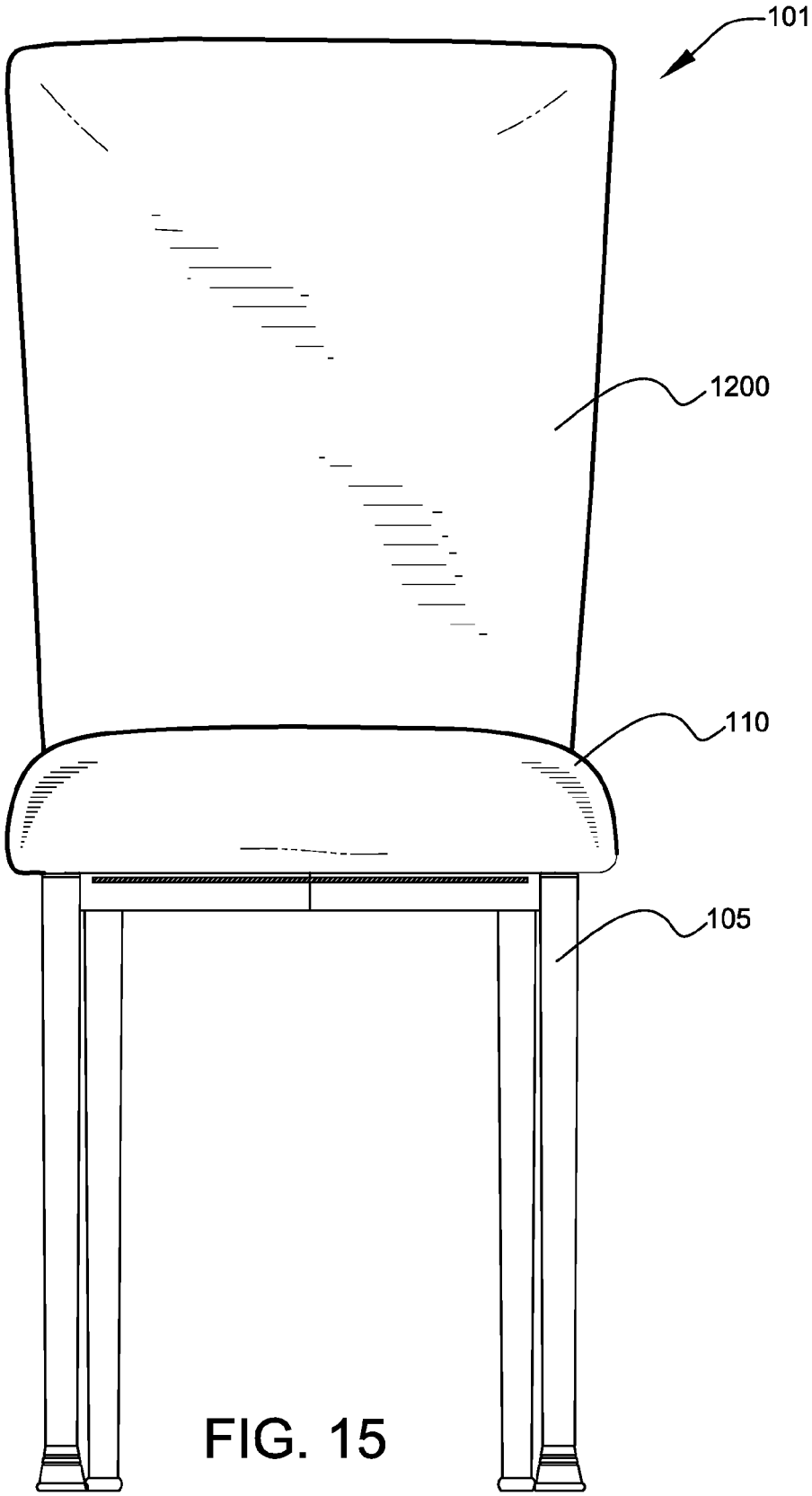
FIG. 15 shows a front view illustrating the modular stackable chair according to the preferred embodiment of FIG. 1 using the chair-back cover and with the chair seat installed.

FIG. 15 shows a front view illustrating modular stackable chair 101 according to the preferred embodiment of FIG. 1 using chair-back cover 1200 and with chair seat 110 installed. Preferably, chair-back cover 1200 is selected to either match or attractively contrast with the selected chair seat 110 and/or chair frame 105.

Figure 16:
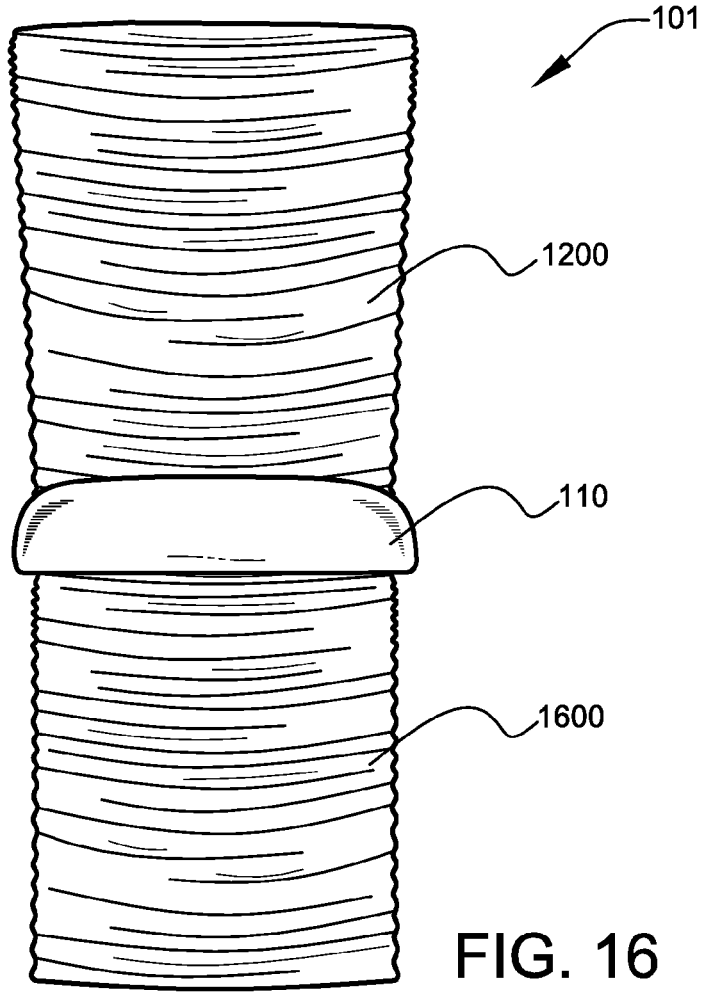
FIG. 16 shows a front view illustrating the modular stackable chair according to the preferred embodiment of FIG. 1 using a chair-back cover and a chair-leg cover with the chair seat installed.

FIG. 16 shows a front view illustrating modular stackable chair 101 according to the preferred embodiment of FIG. 1 using chair-back cover 1200 and chair-leg cover 1600 with chair seat 110 installed. Preferably, modular furniture system 100 comprises chair-leg cover 1600, as shown. Preferably, chair-leg cover 1600 is adapted to cover front legs 120 and back legs 125, as shown, preferably providing an attractive appearance. Preferably, chair-leg cover 1600 comprises fabric, as shown. Preferably, chair-leg cover 1600 attaches adjacent at least the top ends and the bottom ends of front legs 120 and back legs 125. Preferably, chair-leg cover 1600 is selected to either match or attractively contrast with the selected chair-back cover 1200, chair seat 110, and/or chair frame 105. In the present preferred embodiment, chair-leg cover 1600 and chair-back cover 1200 are made to have an attractive draped and wrinkled appearance, as shown. Preferably, chair-leg cover 1600 does not cover chair seat 110 (at least embodying herein at least one chair-leg cover adapted to cover at least one of such plurality of thin leg-bars and to not cover such at least one modular chair seat; and at least embodying herein wherein such at least one chair-leg cover is adapted to cover exactly four of such plurality of thin leg-bars and to not cover such at least one modular chair seat), as shown. Preferably, chair-leg cover 1600 does not substantially cover chair back 115, as shown. Upon reading the teachings of this specification, those with ordinary skill in the art will now understand that, under appropriate circumstances, considering such issues as advances in technology, user preference, etc., other chair-leg cover arrangements, such as other materials, padding, stiffeners, liners, indicia, only covering two chair legs, only covering a portion of the length of the legs, a non-draped appearance, a unitary back and legs cover, etc., may suffice.

FIG. 17 shows a side view illustrating modular stackable chair 101 according to the preferred embodiment of FIG. 16 using chair-back cover 1200 and chair-leg cover 1600 with chair seat 110 installed.

Figure 18:
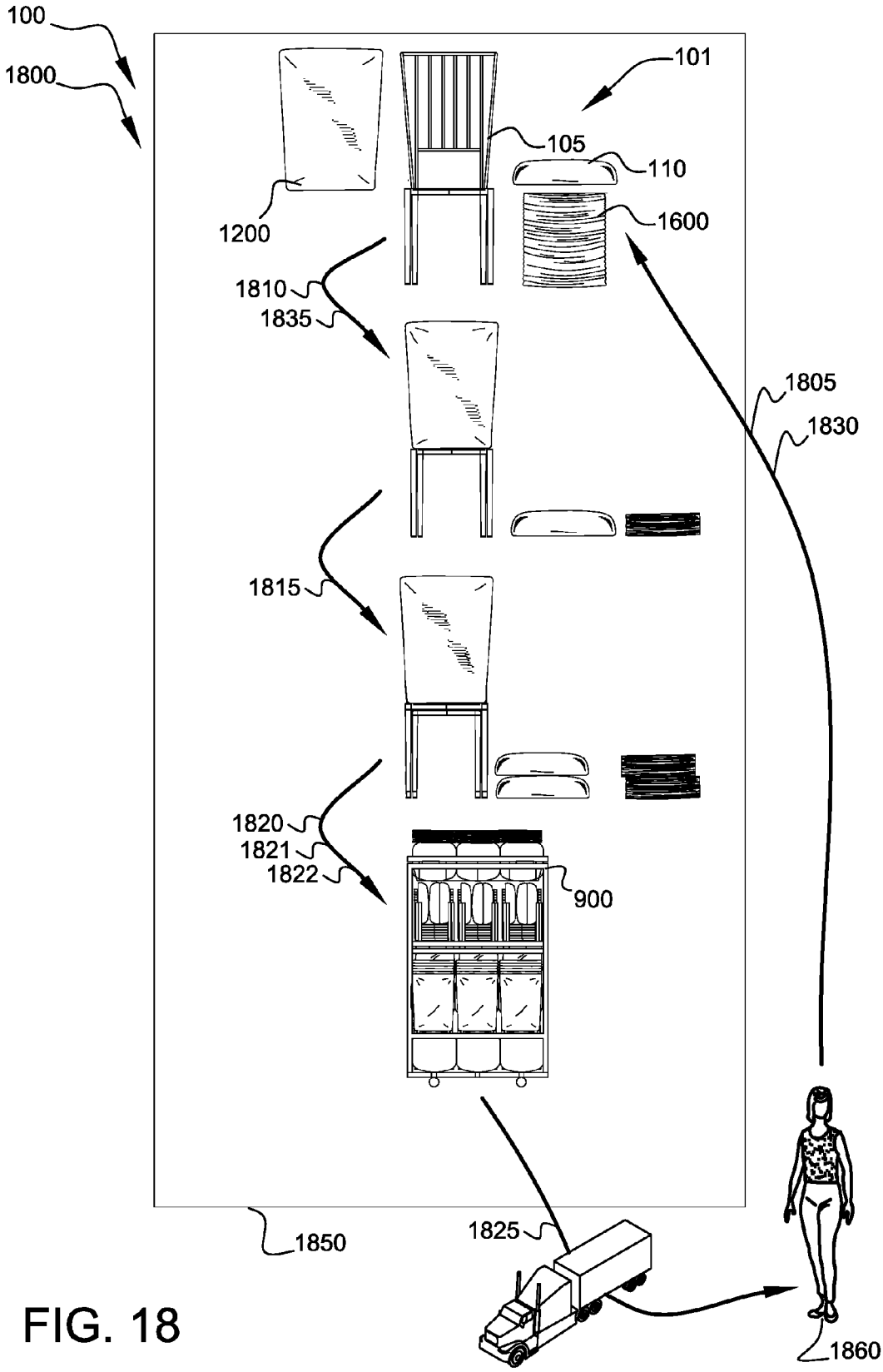
FIG. 18 shows a diagram illustrating a method according to the preferred embodiment of the present invention.

FIG. 18 shows a diagram illustrating method 1800 according to a preferred embodiment of the present invention. Preferably, modular furniture system 100 comprises method 1800. Preferably, method 1800 comprises the step of receiving 1805 customer 1860's order for at least two modular stackable chairs 101 having customer-selected chair frames 105, chair backs 118, chair-leg covers 1600, and chair seats 110; assembling 1810 such customer-selected chair frames 105 and such customer-selected chair backs 118 into at least two seatless modular stackable chairs 101 (preferably at rental-warehouse 1850); stacking 1818 such at least two seatless modular stackable chairs 101 together into at least one stack; loading 1820 such at least one stack onto dolly 900; loading 1821 such customer-selected chair seats 118 onto dolly 900; loading 1822 such customer-selected chair-leg covers 1600 onto dolly 900; and delivering 1825 dolly 900 to customer 1860, as shown. Preferably, method 1800 further comprises the step of receiving 1830 customer 1860's order for at least two modular stackable chairs 101 having customer-selected chair frames 105, chair backs 118, chair-leg covers 1600, chair-back covers 1200, and chair seats 110; and installing 1835 such chair-back covers 1200 on such seatless modular stackable chairs 101, as shown. This arrangement reduces the number of man-hours required for setup at customer 1860's location. Upon reading the teachings of this specification, those with ordinary skill in the art will now understand that, under appropriate circumstances, considering such issues as advances in technology, user preference, etc., other arrangements, such as, additional steps, using other dollies, separately transporting some components, etc., may suffice.

Figure 19:
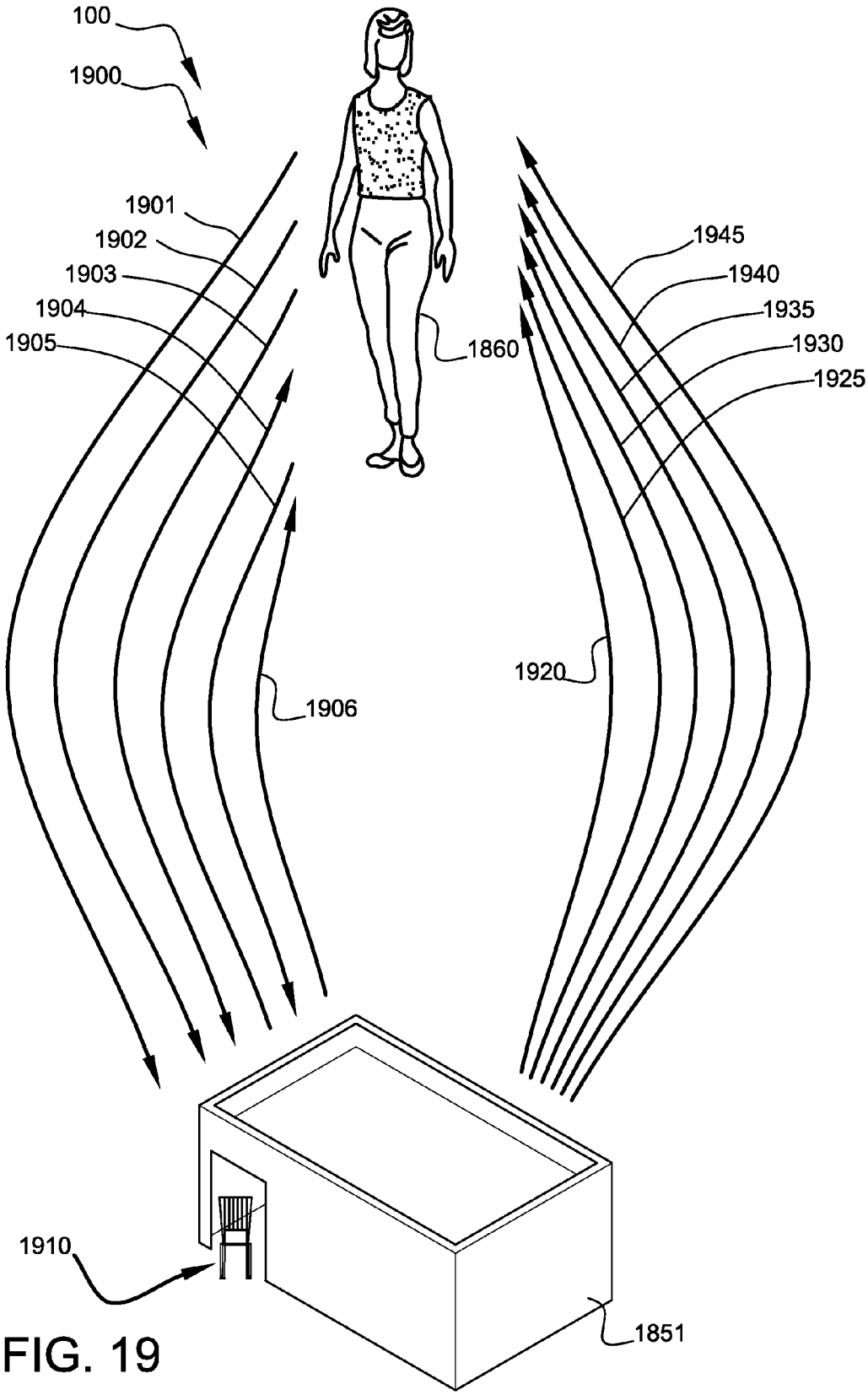
FIG. 19 shows a diagram of another method according to the preferred embodiment of the present invention.

FIG. 19 shows a diagram of method 1900 according to a preferred embodiment of the present invention. Preferably, modular furniture system 100 comprises method 1900, as shown. Preferably, method 1900 is performed by source 1951, preferably at rental-warehouse 1850, and preferably comprises the steps of: receiving 1901 (at least embodying herein the step of receiving at least one customer's selection of at least one chair frame) at least one customer 1860's selection of at least one nesting-stackable chair frame 105; receiving 1902 (at least embodying herein the step of receiving such customer's selection of at least one chair seat) such customer 1860's selection of at least one modular chair seat 110; receiving 1903 (at least embodying herein the step of receiving such customer's selection of at least one back cover) such customer 1860's selection of at least one removable back cover 1600; and providing 1904 (at least embodying herein the step of providing furniture comprising such at least one nesting-stackable chair frame, such at least one modular chair seat, and such at least one removable back cover to such at least one customer) furniture comprising chair frame 105, modular chair seat 110, and removable back cover 1600 to such customer 1860, as shown.

Preferably, method 1900 further comprises the step of receiving 1905 (at least embodying herein the step of receiving such customer's selection of at least one removable chair-leg cover) such customer 1860's selection of at least one chair-leg cover 1600, as shown.

Preferably, method 1900 further comprises the step of manufacturing 1910 (at least embodying herein the step of manufacturing such at least one chair frame) such at least one chair frame 105, as shown.

Preferably, such step of providing 1904 furniture comprises the step of renting 1906 furniture comprising the selected components (at least embodying herein the step of renting furniture comprising such at least one nesting-stackable chair frame, such at least one modular chair seat, and such at least one removable back cover to such at least one customer), as shown.

Preferably, such step of providing 1904 furniture comprises the step of selling 1915 to such customer 1860 furniture comprising the selected components (at least embodying herein the step of selling furniture comprising such at least one nesting-stackable chair frame, such at least one modular chair seat, and such at least one removable back cover to such at least one customer), as shown.

Preferably, such step of selling 1915 furniture comprises the step of providing 1920 (at least embodying herein wherein such step of providing furniture comprises the step of providing at least one franchise to such customer) at least one franchise to such customer 1860, as shown. Preferably, said step of providing 1920 at least one franchise to such customer 1860 comprises the step of providing 1925 (at least embodying herein wherein such step of providing at least one franchise to such customer comprises the step of providing at least one chair rental territory to such at least one customer) at least one chair rental territory to such at least one customer 1860, as shown. Preferably, source 1951 provides modular chair rental franchises to customer 1860, as shown. Preferably, such franchises allow source 1951 to define the rental territory served by customer 1860, as shown. Preferably, such franchises allow source 1951 to implement quality-control conditions on the rental of modular stackable chair 101 that have been purchased (leased, stocked, rented, etc.) by customer 1860.

Preferably, said step of providing 1920 at least one franchise to such customer 1860 comprises the step of offering 1930 at (at least embodying herein wherein such step of providing at least one franchise to such customer comprises the step of offering at least one modular chair seat having at least one new aesthetic design to such at least one customer) least one chair seat 110 having at least one new aesthetic design to such at least one customer 1860, as shown. Preferably, such step of providing 1920 at least one franchise to such customer 1860 comprises the step of offering 1935 (at least embodying herein wherein such step of providing at least one franchise to such customer comprises the step of offering at least one removable back cover having at least one new aesthetic design to such at least one customer) at least one back cover 1600 having at least one new aesthetic design to such customer 1860, as shown. Preferably, such step of providing 1920 at least one franchise to such customer 1860 comprises the step of offering 1940 (at least embodying herein wherein such step of providing at least one franchise to such customer comprises the step of offering at least one nesting-stackable chair frame having at least one new aesthetic design to such at least one customer) at least one chair frame 105 having at least one new aesthetic design to such at least one customer 1860, as shown. Preferably, such step of providing 1920 at least one franchise to such customer 1860 comprises the step of offering 1945 (at least embodying herein wherein such step of providing at least one franchise to such customer comprises the step of offering at least one removable chair-leg cover having at least one new aesthetic design to such at least one customer) at least one chair-leg cover 1600 having at least one new aesthetic design to such at least one customer 1860, as shown. Preferably, source 1951 offers new modular stackable chair 101 components to franchising customers 1860 in order to allow franchising customers 1860 to stock modular stackable chair 101 components having new colors and/or designs as fashions change. Upon reading the teachings of this specification, those of ordinary skill in the art will now understand that, under appropriate circumstances, such as user preference, advances in technology, intended use, etc., other steps, such as maintaining an e-commerce web site, shipping modular furniture components, assembling modular furniture components at the customer's site, manufacturing other modular furniture components, etc., may suffice.

Figure 20A:
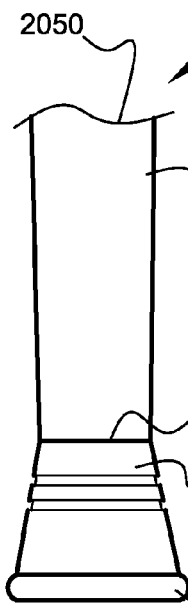
FIG. 20A shows a front view illustrating a reinforced front chair foot installed in a front leg according to the preferred embodiment of FIG. 1.
Figure 20B:
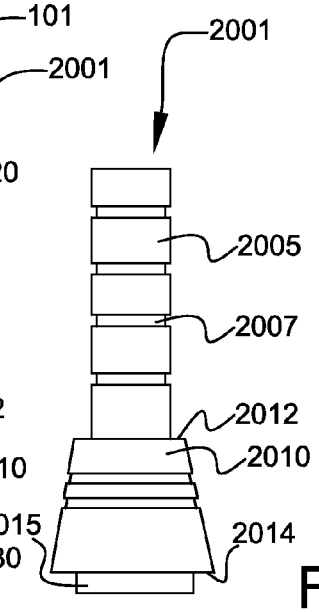
FIG. 20B shows a front view illustrating the reinforced front chair foot according to the preferred embodiment of FIG. 20A.
Figure 20C:
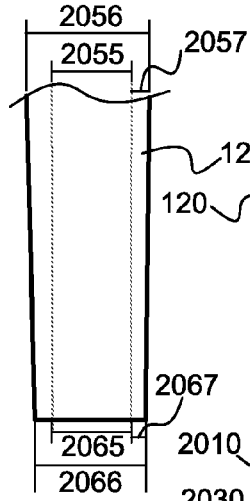
FIG. 20C shows section 20C-20C of FIG. 20A illustrating the tapered strengthened chair front leg according to the preferred embodiment of FIG. 20A.
Figure 20F:
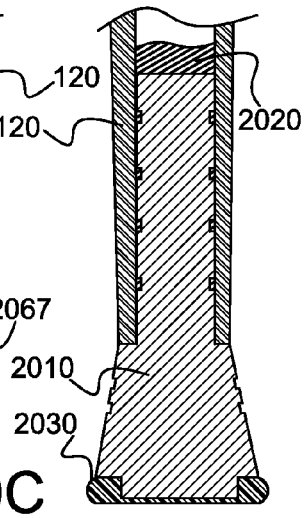
FIG. 20F shows section 20C-20C of FIG. 20A illustrating the tapered strengthened chair front leg with the front foot installed according to the preferred embodiment of FIG. 20A.
Figure 20E:
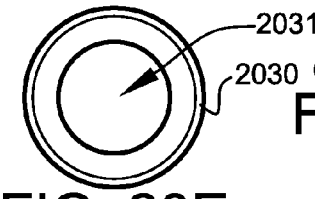
FIG. 20E shows a top view illustrating the floor cap according to the preferred embodiment of FIG. 20D.
Figure 20D:
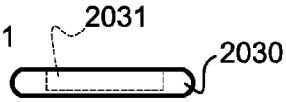
FIG. 20D shows a front view illustrating the floor cap according to the preferred embodiment of FIG. 20A.

FIG. 20A shows a front view illustrating a reinforced front chair foot 2001 installed in front leg 120 according to the preferred embodiment of FIG. 1. FIG. 20B shows a front view illustrating reinforced front chair foot 2001 according to the preferred embodiment of FIG. 20A. FIG. 20C shows section 20C-20C of FIG. 20A illustrating tapered strengthened chair front leg 120 according to the preferred embodiment of FIG. 20A. FIG. 20D shows a front view illustrating floor cap 2030 according to the preferred embodiment of FIG. 20A. FIG. 20E shows a top view illustrating floor cap 2030 according to the preferred embodiment of FIG. 20D. FIG. 20F shows section 20C-20C of FIG. 20A illustrating tapered strengthened chair front leg 120 with front foot 2001 installed according to the preferred embodiment of FIG. 20A.

Preferably, front leg 120 is tapered from top end 2050 (adjacent crossbars 130) to bottom end 2052 (adjacent the ground), as shown. Preferably, front leg 120 comprises top inner diameter 2055, top outer diameter 2056, and top wall thickness 2057 (at least embodying herein at least one metal tube comprising at least one bottom end adapted to be adjacent the ground in use, at least one top end adapted to be connected to such at least one frame support, at least one inside aperture diameter, at least one outside diameter, and at least one wall thickness), as shown. Preferably, front leg 120 comprises bottom inner diameter 2065, bottom outer diameter 2066, and bottom wall thickness 2067, as shown. Preferably, front leg 120 is swaged to shape from a straight-sided tube. Preferably, the swaging process works and hardens the metal of front leg 120 (at least embodying herein wherein such at least one portion comprises at least one work-hardened metal microstructure relative to such at least one other portion of such at least one metal tube). Preferably, bottom outer diameter 2066 is about three-fourths of top outer diameter 2056, as shown. Preferably, bottom wall thickness 2067 is greater than top wall thickness 2057 (at least embodying herein wherein at least one portion of such at least one metal tube, at least including such at least one bottom end, comprises at least one reduced outside diameter and at least one increased wall thickness relative to at least one other portion of such at least one metal tube), as shown. This results in greater lower-leg strength without increasing the overall weight of chair 101. Upon reading the teachings of this specification, those with ordinary skill in the art will now understand that, under appropriate circumstances, considering such issues as advances in technology, user preference, materials strength, etc., other arrangements, such as other methods of tapering the legs (casting the legs in a tapered shape, cutting the legs to shape on a lathe, forging the legs in a tapered shape), other taper diameters, other final wall thicknesses, using untapered legs, etc., may suffice.

Preferably, modular stackable chair 101 comprises reinforced foot 2001, as shown. Preferably, reinforced foot 2001 strengthens at least part of front leg 120 against breakage during rough use (especially tipping modular stackable chair 101 forward in use). Preferably, reinforced foot 2001 comprises a single piece of material, as shown. Preferably, reinforced foot 2001 comprises metal. Most preferably, reinforced foot 2001 (at least embodying herein wherein such at least one chair-foot comprises steel) comprises steel. Preferably, reinforced foot 2001 (at least embodying herein wherein such at least one chair-foot is adapted to lower the center of gravity of such at least one chair frame; and at least embodying herein wherein such at least one chair-foot is adapted to provide weight sufficient to increase the tipping stability of such at least one chair frame) has sufficient weight to assist in counterbalancing chair frame 105 against the weight of chair back 115 in order to enhance the ground stability of chair frame 105. Preferably, reinforced foot 2001 (at least embodying herein at least one chair-foot adapted to increase the strength of such at least one chair frame) comprises shank 2005 and base 2010, as shown.

Preferably, shank 2005 comprises indents 2007, as shown. Preferably, shank 2005 is inserted into the bottom of front leg 120, as shown. Preferably, shank 2005 is about three inches long. Preferably, shank 2005 is secured within front leg 120 using adhesive 2020, as shown. Preferably, adhesive 2020 comprises epoxy. Preferably, indents 2007 assist in securing shank 2005 in adhesive 2020, as shown (similar-looking indents on base 2010 are decorative). Upon reading the teachings of this specification, those with ordinary skill in the art will now understand that, under appropriate circumstances, considering such issues as advances in technology, user preference, materials strength, etc., other reinforced feet, such as press-fit feet, other shank diameters, other shank lengths, multi-part reinforced feet, lack of indents, etc., may suffice.

Preferably, base 2010 comprises top edge 2012, bottom edge 2014, and cap extension 2015, as shown. Preferably, top edge 2012 has substantially the same diameter as bottom outer diameter 2066 for aesthetic reasons, as shown. Preferably, bottom edge 2014 (at least embodying herein wherein such at least one chair-foot is adapted to increase the tipping stability of such at least one chair frame) has substantially the same diameter as top outer diameter 2056, as shown, thereby restoring the footprint lost by tapering front leg 120, in order to enhance the ground stability of chair frame 105. Upon reading the teachings of this specification, those with ordinary skill in the art will now understand that, under appropriate circumstances, considering such issues as advances in technology, user preference, materials strength, etc., other chair feet, such as other base sizes, other base diameters, decorative feet, smooth metal feet, felt-tipped feet, caps that slip over the ends of the legs, wheels, runners, pontoons, etc., may suffice.

Preferably, floor cap 2030 attaches to base 2010, as shown, so that chair 101 easily slides across floors for the convenience of the user. More preferably, floor cap 2030 attaches to cap extension 2015, as shown. Preferably, cap extension 2015 inserts into recess 2031 in floor cap 2030, as shown. Preferably, floor cap 2030 frictionally attaches to cap extension 2015. Preferably, floor cap 2030 comprises at least one strong, smooth material adapted to protect floors from damage. Preferably, floor cap 2030 is substantially disc-shaped. Preferably, floor cap 2030 comprises plastic. Most preferably, floor cap 2030 comprises nylon. Preferably, floor cap 2030 has a greater diameter than the diameter of bottom edge 2014, as shown, in order to further enhance the ground stability of chair frame 105.

Figure 21A:
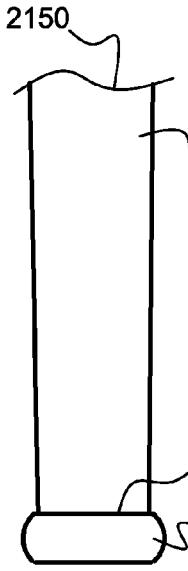
FIG. 21A shows a front view illustrating a rear chair foot installed in a rear leg according to the preferred embodiment of FIG. 1.
Figure 21B:
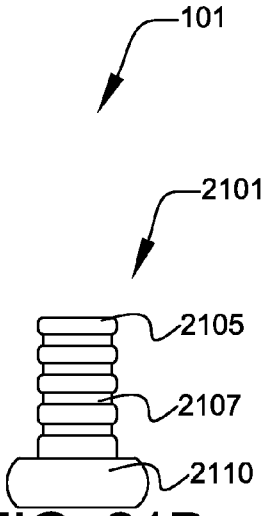
FIG. 21B shows a front view illustrating the rear chair foot according to the preferred embodiment of FIG. 21A.
Figure 21D:
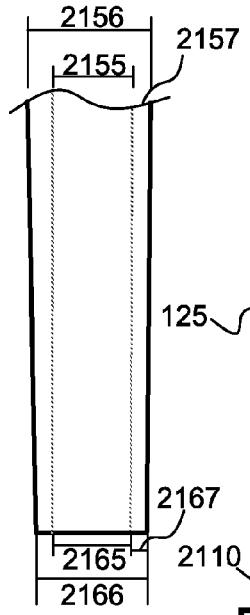
FIG. 21D shows section 21D-21D of FIG. 21A illustrating the tapered strengthened chair rear leg according to the preferred embodiment of FIG. 21A.
Figure 21E:
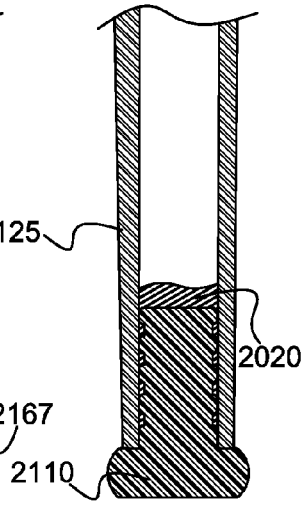
FIG. 21E shows section 21D-21D of FIG. 21A illustrating the tapered strengthened chair rear leg with the rear foot installed according to the preferred embodiment of FIG. 21A.
Figure 21C:
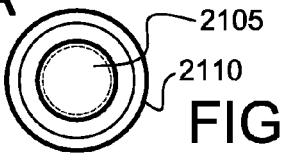
FIG. 21C shows a top view illustrating the rear chair foot according to the preferred embodiment of FIG. 21A.

FIG. 21A shows a front view illustrating rear chair foot 2101 installed in rear leg 125 according to the preferred embodiment of FIG. 1. FIG. 21B shows a front view illustrating rear chair foot 2101 according to the preferred embodiment of FIG. 21A. FIG. 21C shows a top view illustrating rear chair foot 2101 according to the preferred embodiment of FIG. 21A. FIG. 21D shows section 21D-21D of FIG. 21A illustrating tapered strengthened chair rear leg 125 according to the preferred embodiment of FIG. 21A. FIG. 21E shows section 21D-21D of FIG. 21A illustrating tapered strengthened chair rear leg 125 with rear chair foot 2101 installed according to the preferred embodiment of FIG. 21A.

Preferably, rear leg 125 is tapered from top end 2150 (adjacent crossbars 130) to bottom end 2152 (adjacent the ground), as shown. Preferably, rear leg 125 comprises top inner diameter 2155, top outer diameter 2156, and top wall thickness 2157, as shown. Preferably, rear leg 125 comprises bottom inner diameter 2165, bottom outer diameter 2166, and bottom wall thickness 2167, as shown. Preferably, rear leg 125 is swaged to shape from a straight-sided tube. Preferably, the swaging process works and hardens the metal of at least part of rear leg 125. Preferably, bottom outer diameter 2166 is about three-fourths of top outer diameter 2156, as shown. Preferably, bottom wall thickness 2167 is greater than top wall thickness 2157, as shown. This results in greater lower-leg strength without increasing the overall weight of chair 101.

Preferably, modular stackable chair 101 comprises foot 2101, as shown. Preferably, foot 2101 supports rear leg 125, as shown, so that bottom end 2152 does not damage floors and so that chair 101 easily slides across floors for the convenience of the user. Preferably, foot 2101 comprises a single piece of material, as shown. Preferably, foot 2101 comprises plastic. Most preferably, foot 2101 comprises nylon. Preferably, foot 2101 comprises shank 2105 and base 2110, as shown.

Preferably, shank 2105 comprises indents 2107, as shown. Preferably, shank 2105 is inserted into the bottom of rear leg 125, as shown. Preferably, shank 2105 is about two inches long. Preferably, shank 2105 is secured within rear leg 125 using adhesive 2020, as shown. Preferably, adhesive 2020 comprises epoxy. Preferably, indents 2107 assist in securing shank 2105 in adhesive 2020, as shown. Preferably, base 2110 has substantially the same diameter as top outer diameter 2056, as shown, thereby restoring the footprint lost by tapering rear leg 125, in order to enhance the ground stability of chair frame 105. Upon reading the teachings of this specification, those with ordinary skill in the art will now understand that, under appropriate circumstances, considering such issues as advances in technology, user preference, materials strength, etc., other chair feet, such as decorative feet, smooth metal feet, felt-tipped feet, caps that slip over the ends of the legs, wheels, runners, pontoons, etc., may suffice.

Figure 22:
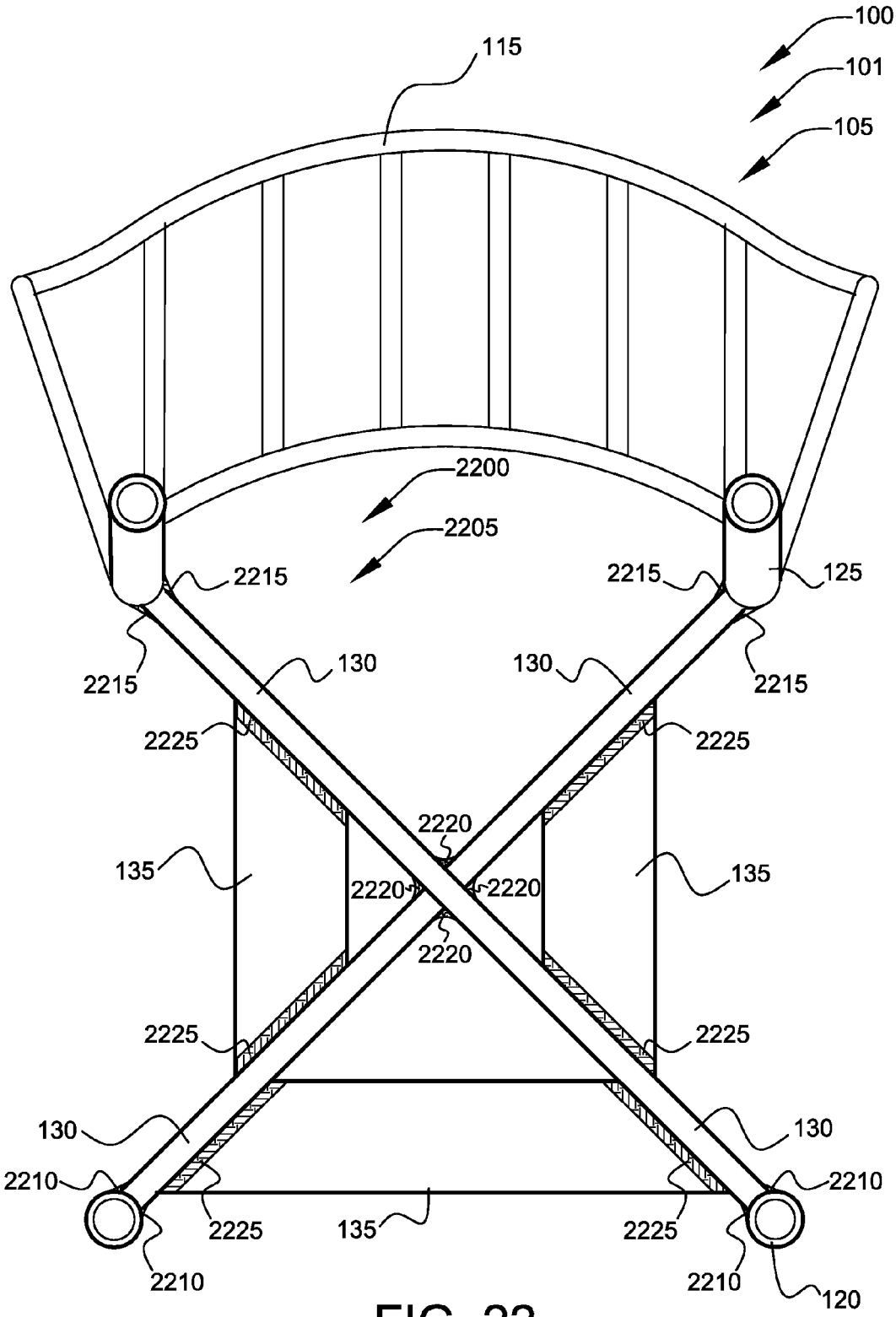
FIG. 22 shows a bottom view illustrating the modular stackable chair according to FIG. 1 and detailing structural reinforcements.

FIG. 22 shows a bottom view illustrating modular stackable chair 101 according to the preferred embodiment of FIG. 1 detailing structural reinforcements. Preferably, chair frame 105 comprises reinforcements 2200, as shown. Preferably, reinforcements 2200 stiffen and strengthen chair frame 105 in order to permit rugged rental use without compromising nesting-stackability. Preferably, reinforcements 2200 (at least embodying herein at least one frame support strengthener adapted to strengthen such at least one frame support whereby such at least one frame support comprises the substantially exclusive structural connection between such plurality of thin leg-bars) stiffen and strengthen chair frame 105 sufficiently that stretchers between the legs are not required for functionality, as shown. Preferably, reinforcements 2200 comprise built-up welds 2205, as shown. Preferably, built-up welds 2205 comprise front-leg welds 2210 between each front leg 120 and each crossbar 130, as shown. Preferably, built-up welds 2205 comprise rear-leg welds 2215 between each rear leg 125 and each crossbar 130, as shown. Preferably, built-up welds 2205 comprise crossbar welds 2220 between crossbars 130, as shown. Preferably, built-up welds 2205 comprise crossbar-plate welds 2225 between crossbars 130 and crossbar plates 135, as shown. Upon reading the teachings of this specification, those with ordinary skill in the art will now understand that, under appropriate circumstances, considering such issues as advances in technology, user preference, aesthetic design, materials strength, etc., other reinforcements, such as additional crossbar plates, larger crossbar plates, a crossbar plate between the crossbars adjacent the seat back, using the seat back structure as reinforcement, etc., may suffice.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A modular furniture system, relating to object-supporting furniture having modular portions, comprising:

a) at least one chair frame comprising
  i) at least one back support,
  ii) at least one seat support,
  iii) at least four legs comprising at least two front legs and at least two rear legs;

b) said at least one seat support comprising
  i) at least four longitudinal projections extending from at least one hub portion, and
  ii) at least one plate connecting at least two of said at least four longitudinal projections;

c) at least one chair seat; and d) at least one attachment system structured and arranged to assist attachment and detachment of said at least one chair seat from said at least one seat support;

e) wherein detachment of said at least one chair seat from said at least one seat support is effected by lifting said at least one chair seat away from said at least one seat support;

f) wherein said at least one chair frame is structured and arranged to nest in a stack with at least one other substantially identical chair frame, when said at least one chair seat is detached from each said at least one seat support;

g) wherein said at least one seat support further comprises horizontal-plane apertures structured and arranged to receive said at least two rear legs of at least one other substantially identical chair frame during stacking of multiple units of said chair frames;

h) wherein said at least one chair seat occludes said horizontal-plane apertures when attached to said at least one chair frame; and i) wherein each of said at least four legs comprises
  i) at least one metal tube comprising
    (1) at least one bottom end structured and arranged to be adjacent the ground in use,
    (2) at least one top end structured and arranged to be connected to said at least one seat support,
    (3) at least one inside aperture diameter,
    (4) at least one outside diameter, and
    (5) at least one wall thickness;
  ii) wherein at least one portion of said at least one metal tube, at least including said at least one bottom end, comprises at least one reduced outside diameter and at least one increased wall thickness relative to at least one other portion of said at least one metal tube.

2. The modular furniture system according to claim 1 wherein said at least one portion comprises at least one work-hardened metal microstructure relative to said at least one other portion of said at least one metal tube.

* * * * *